US010677574B2

(12) United States Patent
Panousakis

(10) Patent No.: US 10,677,574 B2
(45) Date of Patent: Jun. 9, 2020

(54) SELF CONTAINED INTERNAL CHAMBER FOR A PROJECTILE

(71) Applicant: Dimosthenis Panousakis, Athens (GR)

(72) Inventor: Dimosthenis Panousakis, Athens (GR)

(73) Assignee: Dimosthenis Panousakis, Athens (GR)

( * ) Notice: Subject to any disclaimer, the term of this patent is extended or adjusted under 35 U.S.C. 154(b) by 0 days.

(21) Appl. No.: 15/583,536

(22) Filed: May 1, 2017

(65) Prior Publication Data

US 2017/0322001 A1 Nov. 9, 2017

Related U.S. Application Data

(60) Provisional application No. 62/330,989, filed on May 3, 2016.

(51) Int. Cl.

| | |
|---|---|
| ***F42B 10/28*** | (2006.01) |
| ***F42B 10/30*** | (2006.01) |
| ***F42B 10/38*** | (2006.01) |
| ***F42B 15/00*** | (2006.01) |

(Continued)

(52) U.S. Cl.

CPC ..... *F42B 10/28* (2013.01); *F42B 5/10* (2013.01); *F42B 10/30* (2013.01); *F42B 10/38* (2013.01); *F42B 15/00* (2013.01); *F42B 5/02* (2013.01)

(58) Field of Classification Search

CPC .... F42B 5/02; F42B 5/10; F42B 10/28; F42B 10/30; F42B 10/38; F42B 15/00

USPC ..... 102/372, 374, 376, 380, 381, 439, 501, 102/517

See application file for complete search history.

(56) References Cited

U.S. PATENT DOCUMENTS

| | | | |
|---|---|---|---|
| 1,285,599 | A | 11/1918 | Bennett |
| 1,302,272 | A | 4/1919 | Aoughsten |
| 2,408,252 | A | 9/1946 | Ganahl |

(Continued)

FOREIGN PATENT DOCUMENTS

| | | | |
|---|---|---|---|
| NL | 7114356 | A | 4/1972 |

OTHER PUBLICATIONS

Thomas et al.: United States Invention Registration, Reg. No. H203, Published Feb. 3, 1987, Integral Rocket Motor-Warhead.

(Continued)

*Primary Examiner* — James S Bergin

(74) *Attorney, Agent, or Firm* — Park, Vaughan, Fleming & Dowler LLP; Shane Nelson

(57) ABSTRACT

The present disclosure provides a projectile with a self-contained internal chamber. Reaction of propellant inside the internal chamber can generate high pressure and the resultant exhaust gases can be used for projectile linear acceleration, rotational acceleration or other purposes. Torque can be produced by exhausting the pressure via radially placed, tangential nozzles or other outlets and can be configured to induce sufficient projectile spin to stabilize the projectile without the need for barrel rifling. The internal chamber may be separate or integral to the projectile itself. The projectile may include two or more chambers or compartments internal to the chambers. The disclosed projectile allows for higher pressures in the internal chamber than in the barrel and greater flexibility on pressure manipulation in the barrel and the projectile, allowing for a more efficient propellant combustion and manipulation of projectile characteristics such as muzzle and rotational speeds.

26 Claims, 10 Drawing Sheets

(51) Int. Cl.
*F42B 5/10* (2006.01)
*F42B 5/02* (2006.01)

(56) References Cited

U.S. PATENT DOCUMENTS 2,426,239 A 8/1947 Renner
2,489,953 A 11/1949 Burney
2,941,469 A 6/1960 Barnhart
3,060,854 A 10/1962 Maretti
3,205,431 A 9/1965 Herrick, Jr.
3,212,402 A 10/1965 Hengel et al.
3,349,708 A * 10/1967 Paget ..... F02K 9/32 102/374
3,486,451 A * 12/1969 Moore ..... F42B 5/10 102/517
3,490,121 A 1/1970 Biehl et al.
3,628,457 A 12/1971 Magnusson et al.
3,650,213 A 3/1972 Abbott et al.
3,750,979 A * 8/1973 Nelms ..... F42B 5/10 102/380
3,913,487 A * 10/1975 Scherr ..... F42B 10/38 102/501
3,922,967 A 12/1975 Mertens
4,197,800 A * 4/1980 Greever ..... F42B 15/00 102/376
4,397,240 A * 8/1983 Rottenberg ..... F42B 15/00 102/376
5,263,416 A 11/1993 Amundson
7,021,219 B1 4/2006 Dindl
7,089,863 B1 8/2006 Dindl
8,671,839 B2 3/2014 Bunczk et al.
9,448,026 B2 * 9/2016 O'Dwyer ..... F41A 19/62
2006/0144280 A1 7/2006 Robert et al.
2013/0112100 A1 5/2013 Bunczk et al.

OTHER PUBLICATIONS

International Search Report: PCT/EP2017/060436, Panousakis, Dimosthenis, dated Jul. 12, 2017, European Patent Office.

* cited by examiner

SELF CONTAINED INTERNAL CHAMBER FOR A PROJECTILE

PRIORITY

This application claims priority to U.S. provisional patent application No. 62/330,989, filed on May 3, 2016, the entire content of which is incorporated herein by reference.

BACKGROUND OF THE INVENTION

Field of the Invention

The disclosure generally relates to ammunition, e.g., bullets and other projectiles. Specifically, the disclosure relates to projectiles with an internal chamber that may serve as a high-pressure chamber used to improve performance characteristics of the projectile.

Description of the Related Art

A typical cartridge consists of a bullet (e.g., a projectile), a case or body that holds all the parts of the cartridge together, propellant (e.g., gunpowder) and a primer that ignites the propellant. A bullet or projectile is not a cartridge; rather, the bullet or projectile is just one component of the cartridge and is the part shot through the barrel of a firearm. The bullet may have a variety of shapes, such as spherical, conical, grooved, hollow point, soft point, etc., and may be made from a wide variety of materials. In general, propellant behind the bullet is ignited that creates a combustion reaction that pushes the bullet out of the barrel. In order to impart stabilizing spin, conventional bullets must engage the barrel rifling without damaging or excessively fouling the interior of the barrel (e.g., the bore) and without distorting the bullet. The interactions while the bullet is in the barrel are commonly referred to as internal ballistics. The physics affecting the bullet once it leaves the barrel are commonly referred to as external ballistics and those concerning energy transfer to the target are commonly referred to as terminal ballistics.

Today, most breech loaded weapons fire a projectile that is accelerated by a propellant placed behind it in a rifled barrel to impart spin via mechanical engagement in order to achieve flight stability. The main disadvantage of placing the propellant behind the projectile is that the pressure trace (e.g., the barrel pressure as a function of time) is primarily governed by the propellant's reaction rate and is bell shaped, creating a pressure peak substantially higher than the average pressure experienced by the projectile while in the barrel. Barrels and projectiles need to be designed to withstand the pressure peak although it experiences that pressure for only a fraction of a second. To stabilize the flight path of the projectile, spin is placed on the projectile by rifling in the barrel. The main disadvantage of rifling is the increased bullet/barrel friction. Aggravated by cyclic thermal loading due to blow by gases squeezing their way through the engraving, the dry friction results in barrel contamination and surface deformation. This leads to decreased accuracy after a few shots (without barrel cleaning) and ultimately results in barrel erosion, wear and the need for barrel replacement. The frequency at which replacement is necessary depends on the type of weapon, ranging from only 50 shots in some tank guns to a typical 2000-3000 round life in modern personal firearms. Modern, fast burning, high brisance propellants result in even shorter barrel life. As propellant chemistry improves and cycle rates increase, thermal loading placed on rifling becomes excessive.

In order to avoid metal-to-metal friction, plastic sabots (e.g., the soft ring at the base of a projectile) have been used with rifled barrels as described in U.S. Pat. Nos. 3,847,082, 3,769,912, and 4,063,511, each incorporated herein by reference. However, it is well known that plastic sabots also lead to barrel fouling. Plastic is smeared onto the barrel changing its dimensions and friction characteristics. Another disadvantage with using plastic sabots is that the round has to accelerate the mass of the plastic; however, such acceleration is parasitic, in terms of terminal ballistics, and only provides barrel protection services. Another proposal is to have a sabot that allows some blow by to be directed, via grooves, slots, vanes, nozzles in the sabot in a somewhat tangential manner, as to provide the necessary torque to spin the projectile, such as that disclosed in U.S. Pat. Nos. 2,090,533, 3,015,991, 3,247,795, 3,398,682, 4,176,487, 4,314,510, and 6,085,660, each incorporated herein by reference. However, blow by reduces efficiency by wasting energy. Moreover, incomplete, inefficient combustion and risk of complete extinction is present when sudden, random, drops in pressure occur due to the inherent unsteady leakage. This restricts the amount of blow by that can be used to create rotation and limits the application to low spins.

As another example, U.S. Pat. No. 8,671,839 (the "Bunczk patent"), incorporated herein by reference, discloses a projectile with a cavity and a propellant disposed in the cavity with nozzles exiting the back of the projectile. In general, the Bunczk patent focuses on improvements in rocket-propelled projectiles and is concerned with velocity and rotational forces after the projectile is outside the barrel. The aim of the Bunczk design is to achieve higher velocity and provide/maintain angular momentum through the generation and expulsion of a large volume of gas, not the generation of high pressures in the barrel or the internal chamber. Moreover, placing the nozzles on the back of the projectile as is done in the Bunczk patent limits the radius at which the exhaust nozzles can be placed, provides limited angle, shape, and size of any exhaust nozzles, and greatly reduces the amount of mass flow/thrust from the internal chamber. All of the above limits the amount of torque, and thus spin, that can be produced.

Simply put, existing ammunition provide numerous disadvantages, including projectile acceleration limited to short-pulse combustion methods with inefficient bell-shaped peak pressure trace patterns and mechanical rifling engagement that wears out after limited use. A new technology is needed that provides a better way to accelerate and is impart spin on the projectile. A need exists for an improved projectile that is modular and can be shot from standard weapons at increased and/or prolonged pressures. A need exists for an improved projectile that provides increased combustion efficiencies and produces higher projectile velocities without compromising barrel safety and/or operational cost effectiveness.

BRIEF SUMMARY OF THE INVENTION

The present disclosure provides a projectile with a self-contained internal chamber. Reaction of propellant (such as by combustion or other mechanisms) inside the internal chamber can generate high pressure and the resultant exhaust gases can be used for projectile linear acceleration, rotational acceleration or other purposes. Torque can be produced by exhausting the pressure via radially placed, tangential nozzles or other outlets and can be configured to induce sufficient projectile spin to stabilize the projectile without the need for barrel rifling. The internal chamber may be separate or integral to the projectile itself. The projectile may include two or more chambers or compartments internal to the chambers. The disclosed projectile allows for higher pressures in the internal chamber than in the barrel and greater flexibility on pressure manipulation in the barrel and the projectile, allowing for a more efficient propellant combustion and manipulation of projectile characteristics such as muzzle and rotational speeds.

The present disclosure provides a projectile with at least one internal chamber configured to exhaust gas from the chamber. The projectile may have a plurality of internal chambers as opposed to just one chamber, and one or more of the chambers may be separated into multiple compartments. Each of the plurality of internal chambers may be configured to perform different actions related to the projectile. For example, a first internal chamber may be configured to provide rotational force to the projectile and a second internal chamber may be configured to provide linear acceleration to the projectile. Each of the chambers may be selectively ignitable and/or may contain different amounts of a propellant or different propellants. For example, a first propellant may be located in at least one of the plurality of chambers and a second propellant may be located in at least one of the remaining plurality of chambers. In other embodiments, the first and second propellants are the same, the volume of the first propellant may be greater than the volume of the is second propellant, and/or the first and second propellants may be configured to ignite separately. The projectile may also include a nose, body, tail and backplate. In other embodiments, the internal chamber may be located on a sabot that is coupled to the projectile.

The projectile may exhaust gas generated by combustion or a chemical reaction. In other embodiments, the exhaust gas comprises compressed air. The exhaust gas may impose linear and/or angular acceleration on the projectile and/or increase the linear velocity of the projectile via a series of continuous or separate pressure pulses to the projectile. The projectile's internal chamber(s) may be a passive pressure accumulation chamber. The projectile's internal chamber(s) may be configured to control the duration of any combustion within the chamber. The combustion pressure of the internal chamber(s) may be decoupled from barrel pressure. The projectile's internal chamber(s) may be configured for exhaust flow throttling of exhaust gas. The projectile's internal chamber(s) may be rigid or deformable. The projectile may have one or more exhaust outlets (such as a plurality of nozzles or outlets) coupled to the one or more internal chamber(s) of the projectile. The one or more exhaust outlets may be spaced radially on an exterior surface of the projectile. The exhaust outlets may each have substantially the same shape or different shapes. In some embodiments, one or more of the exhaust outlets are adaptive. The projectile may also include a turbine coupled to at least one chamber of the projectile, wherein the turbine converts pressure from at least one chamber to angular acceleration for the projectile. The turbine may be axial or centrifugal or a hybrid of axial or centrifugal. The projectile may be configured to produce sufficient torque to induce stabilization level projectile spin without the need of barrel rifling. The combustion pressure of the internal projectile chamber(s) may exceed the rated barrel pressure of a weapon used to shoot the projectile. The projectile may be configured to produce an approximately trapezoidal pressure trace in a barrel used to shoot the projectile. The projectile may be configured to produce spin for shot round dispersion. The projectile may be configured to produce specific spin for desired shot round dispersion range. The projectile may have a variety of tail shapes. For example, the tail may be substantially conical or straight, and may be configured to impart drag on the projectile. The projectile may have a variety of nose shapes. For example, the nose may be configured to avoid accidental primer ignition of an adjacent projectile. The nose may be a serrated spin is augmenting nose.

The projectile may be configured for use in shelled/cased ammunition or caseless ammunition. The projectile may be configured for use in non-rifled barrels or rifled barrels. The projectile may also have an inbuilt sacrificial safety device that breaks at a predetermined pressure. The projectile may also have a seal located on an exterior of the projectile, such as an O-ring. The seal may be located forward or rearward of at least one internal chamber. The seal may include an inflatable sealing ring configured to expand by internal combustion pressure of at least one internal chamber. One or more of the plurality of internal chambers may be configured to be directly or indirectly ignited. The projectile may include a primer coupled to an internal chamber. One of the internal chambers of the projectile may be in the shape of a cylindrical tube. At least one of the components of the projectile (such as one or more of the internal chambers) may be made of fiber reinforced composite.

The present disclosure also provides for a projectile with at least one internal chamber (or multiple internal chambers) and propellant disposed in at least one internal chamber, one or more exhaust outlets coupled to at least one internal chamber, a tail, and a nose. The projectile may be configured to be coupled to a cartridge case.

The present disclosure also provides for a munition with a cartridge case and a projectile coupled to the cartridge case. The projectile may comprise a tail and a nose, which may form a body. The munition may have a plurality of chambers. For example, a first chamber may be located within the cartridge case and behind the projectile while a second chamber may be located internally within the projectile. More than a single chamber may be located within the projectile (such as a third or fourth chamber), and each chamber may comprise a plurality of separate compartments. One or more exhaust outlets may be coupled to the internal projectile chamber(s). The second chamber (e.g., the internal projectile chamber) may be configured to ignite directly or indirectly, such as by the first chamber. The combustion pressure of the second chamber may exceed the barrel pressure. The disclosed munition may comprise different propellants (and/or amounts thereof) located in the different chambers. For example, a first mass of a first propellant may be located in the first chamber and a second mass of a second propellant may be located in the second chamber. The different chambers may be coupled to different ignition sources and/or selectively ignited. For example, the first propellant may be coupled to a first ignition source and the second propellant may be coupled to a second ignition source. As another example, the first and second propellants are configured to ignite at separate times.

DETAILED DESCRIPTION

Figure 1A:
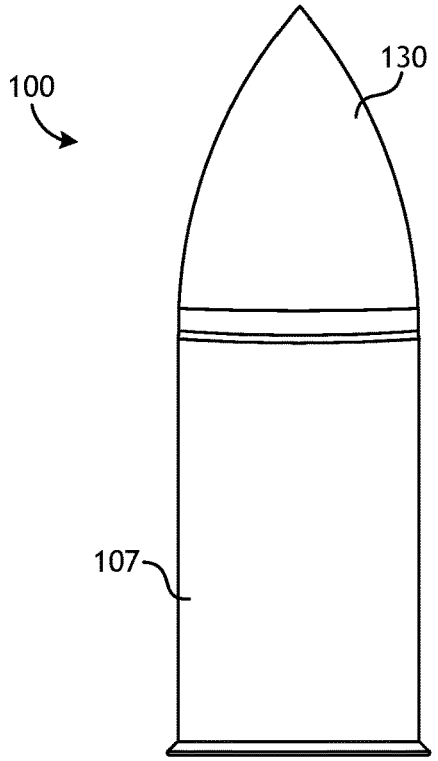
FIGS. 1A and 1B are illustrations of a projectile according to one embodiment of the present disclosure.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, one or more numbered elements may have been labeled with a letter, such as "A" or "B," (or if lettered elements, then with numbers, such as "1" or "2") to designate various members of a given class of an element. When referring generally to such elements, the number without the letter can be used. Further, such designations do not limit the number of members that can be used for that function. The various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires is otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

Various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. Reference throughout the specification to "one embodiment" or "an embodiment" means that a particular feature, structure, or characteristic described in connection with an embodiment is included in at least one embodiment of the subject matter disclosed.

Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments. The following detailed description does not limit the invention.

The present disclosure provides numerous benefits over conventional projectiles. The disclosed projectile provides a modular, adjustable, and cost effective design over conventional projectiles. The disclosed projectile may have one or more internal chambers that serve as a combustion chamber for the projectile, which adds is significant flexibility to the projectile's internal, external, and terminal ballistics performance and potentially the weapons design, particularly as related to barrel design. In general, the disclosed projectile provides a self-contained internal chamber or a series of two or more internal chambers that provides many design capabilities for in-barrel pressure manipulation and/or performance augmentation of the projectile. The exhaust pressure from the projectile's internal chamber(s) can be used for projectile linear acceleration, rotational acceleration, and/or other purposes such as, but not limited to, inflating an O-ring or expelling a sabot. Such internal chamber(s) may be separate or integral to the projectile itself. By having an internal chamber(s), the maximum service barrel pressure limits may be exceeded and the pressure seen by the barrel can be shaded such that the barrel pressure is always under acceptable limits. As described herein, the disclosed projectile produces self-imparted spin, developed by a high-pressure internal chamber that exhausts the pressure via outlets, nozzles, turbines or a similar exhaust mechanism that stabilizes the projectile and can be used over a wide range of calipers. In one embodiment, the exhaust gases from the internal chamber used to rotate the projectile are gathered behind the projectile, contributing to back pressure and/or sustaining high pressure for longer periods inside the barrel. This is a significant advantage of the internal chamber for rotational force versus the inefficiencies of mechanical engagement or non-additive devices such as sabots.

In one embodiment, the present disclosure uses smooth barrels instead of grooved or rifled barrels. Smooth barrels have a number of advantages. Decreased barrel wear is one of them, as there is no severe friction between the projectile and barrel, as is the case in a rifled barrel where mechanical engagement is necessary. This reduced friction can yield higher muzzle velocities and decreased barrel wear, for the same barrel pressure, reducing the need for frequent barrel replacement. This is especially important in fully automatic weapons, where barrels can quickly overheat. By reducing friction and pressure, heat is reduced and it is possible to increase full-auto firing periods. However, the absence of rifling is a main disadvantage of smooth barrels, due to the inability to mechanically induce spin. However, in other embodiments, rifled barrels may be used.

A self-imparting spin projectile (such as that described in the present disclosure) can solve this shortcoming between smooth and rifled barrels. By having a combustion chamber within the projectile exhausting via radially placed, tangential nozzles, outlets, or turbines (or other mechanisms), torque can be created. This torque induces is sufficient projectile spin to provide the desired trait (e.g., stabilization) without the need for rifling. The pressure of the internal chamber can be separated from barrel pressure through a number of design parameters, including, but not limited to, control or throttling of gas release rate, which can be manipulated by outlet design. This design allows for higher pressures to be achieved in the internal chamber, setting the new pressure limit to the chamber's pressure limit and not the barrel's pressure limit (which may be significantly less). Thus, by having the projectile's internal chamber feed the barrel with gas for a longer period of time than conventionally possible, the projectile can be accelerated to velocities beyond the velocities set by conventional practice by maintaining the barrel pressure closer to the barrel's pressure limit for a longer period of time. Thus, a closer to trapezoidal shape pressure trace can be produced, using the barrel length more effectively. The projectile's nozzles (vanes or other combustion gas directing mechanism) can perform a desired function (e.g., accelerate the projectile in a more elaborate fashion and/or rotate it) while fully contributing to barrel pressure and projectile acceleration. As a result, propulsive energy used for rotation does not compromise efficiency, regardless of the amount of propellant that is used for rotation.

In one embodiment, the disclosed projectile increases the performance characteristics of the projectile (e.g., linear velocity, spin) by pressure manipulation. In general, rather than having a single pulse push the projectile (as is done in conventional projectiles), the internal chamber coupled with appropriately designed outlets will produce a smoother, flatter pressure curve that can accelerate the projectile for longer, resulting in higher muzzle velocities and/or torque generation. In one embodiment, the disclosed projectile produces a pressure trace curve approximately in the shape of a trapezoid rather than a bell shaped curve (e.g., a series of smaller pressure pulses instead of a single large pressure pulse as is currently done in the art). In one embodiment, as the projectile gains velocity, faster (and faster) gas generation is required to keep the pressure trace approximately flat. Using more length of the barrel at high-level pressure, even at magnitudes closer to conventional average pressures than conventional peak pressures, will result in a higher overall impulse of the projectile. In one embodiment, the disclosed projectile can have both lower peak and higher average pressures, thereby producing higher projectile velocities from lower peak pressures. More efficient use of combustion pressure means that less propellant can generate higher torque. Importantly, lower peak pressures is means that a firearm barrel can be made thinner, saving cost and weight, or projectiles can achieve greater velocities with a given barrel pressure limit. Additional cost savings can be achieved as rifling is not required even if spin stabilization is desired.

Figure 1B:
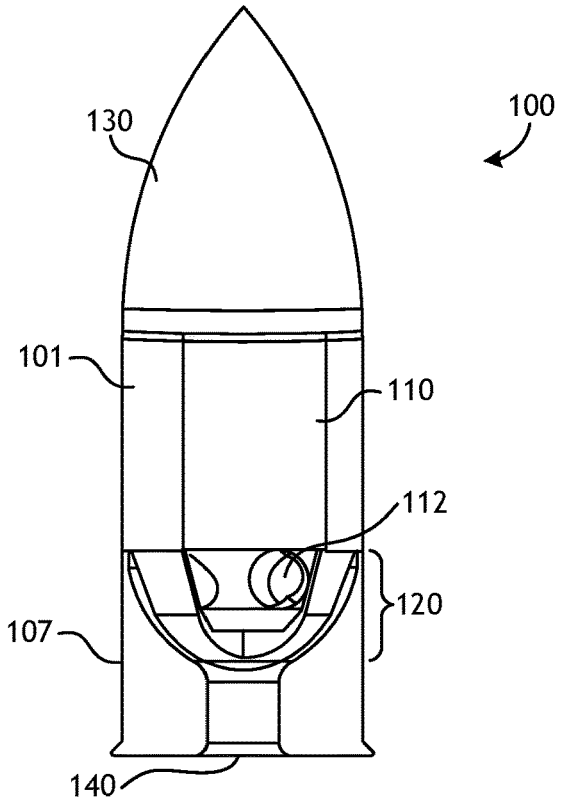

FIGS. 1A and 1B illustrate a schematic of a disclosed munition 100 according to one embodiment of the present disclosure. FIG. 1A shows an exterior of the projectile within and/or inside a casing 107. FIG. 1B shows the same munition 100, but with a cross sectional profile of the internal components of the case and the projectile. Munition 100 may include a projectile comprising at least one internal chamber 110, tail 120, and nose 130. Of course, additional chambers may be used, and each chamber may comprise one or more separated or connected compartments. The tail and/or nose may be separate or integral, and may be formed of the same or different materials. In one embodiment, nose 130 can be threaded/bolted or otherwise attached directly or indirectly to the body. In other embodiments, a bolt (shown in FIG. 2A) may be used to attach the nose to the body. The nose and tail may form projectile body 101, and the internal chamber 110 may be disposed within the body. In other embodiments, the exterior of the internal chamber may form a portion of the body. A propellant may be disposed in internal chamber 110. One or more outlets 112 may be coupled to internal chamber 110. Gases from the projectile's internal chamber 110 feed the barrel chamber through outlets 112. In one embodiment, any gas exhausted from the projectile is substantially symmetric around the projectile and within the barrel; in other embodiments, the exhausted gas is not symmetric. A primer and/or ignition source 140 may be coupled to internal chamber 110.

Figure 2A:
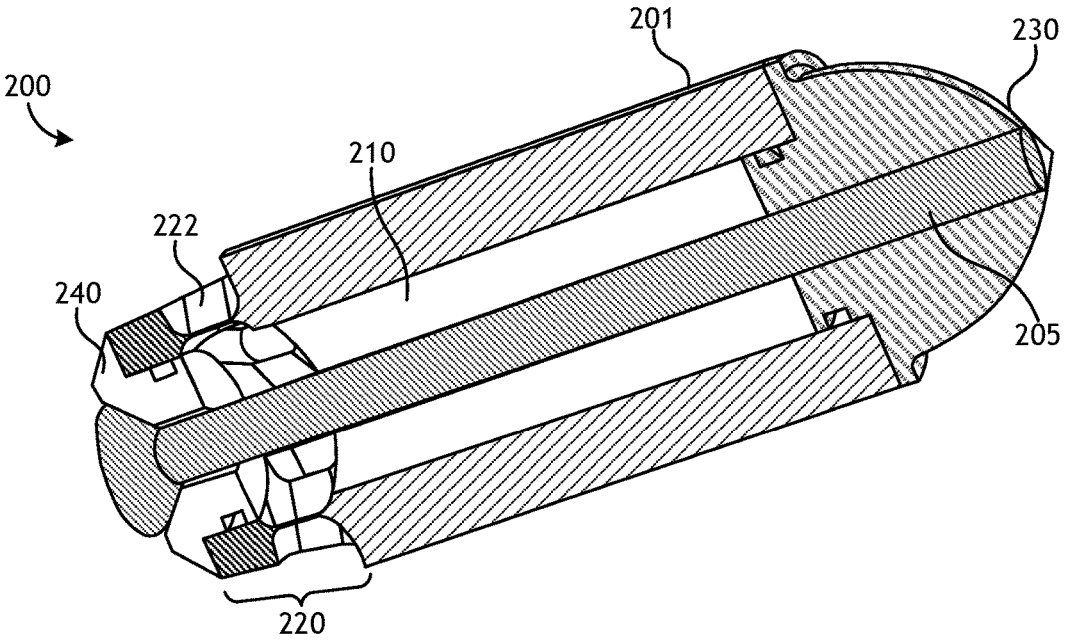
FIG. 2A is an illustration of a projectile according to one embodiment of the present disclosure.
Figure 2B:
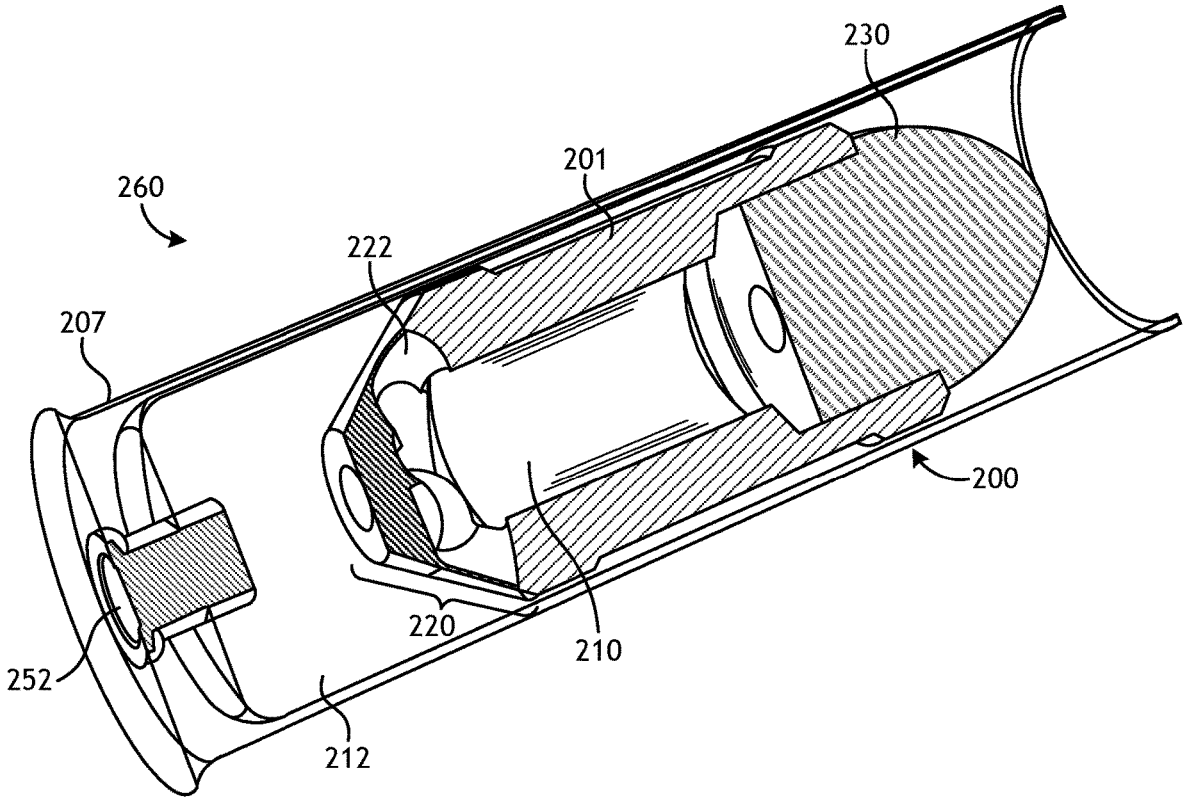
FIG. 2B is an illustration of a projectile according to one embodiment of the present disclosure.

A similar projectile is described in FIG. 2A. As shown in FIG. 2A, projectile 200 includes body 201 with nose 230, tail 220, backplate 240, and primer (not shown). In FIG. 2A, the nose and tail are separate components, and are connected together by bolt 205, which residents within the projectile and connects backplate 240 to nose 230. In some embodiments, the nose and tail can be formed of a single component, thereby a backplate and bolt may not be required. As shown in FIG. 2A, tail 220 comprises a plurality of outlets 222 configured to exhaust pressure/gas from internal chamber 210 to the barrel of the firearm. In some embodiments, the projectile may be fired by itself without being in a shell or casing, or may be placed in a casing or shell as is typical in conventional bullets. In this embodiment, an ignition source may be part of the projectile itself or external to the projectile, such as being located in a rim or casing head of a casing/shell that the disclosed projectile sits within, as shown in FIG. 2B. In some is embodiments, an outer surface of the projectile may be coupled to a sealing element (not shown in FIG. 2B), which is described in more detail in relation to FIGS. 7A-7D. In one embodiment, the combustion pressure of the internal chamber is decoupled from barrel pressure. In other words, by having a pressure controlled chamber (e.g., a chamber where barrel pressure does not communicate directly to an outside space) combustion in that chamber can be independent of barrel pressure. For example, in one embodiment, the projectile's outlets are sized such that the gases created from combustion within the internal chamber can keep the pressure inside the chamber high enough to sustain combustion inside the chamber regardless of barrel pressure.

In other embodiments, while the projectile itself may have an internal chamber, it may be used in conjunction with an ammunition and/or cartridge that has a separate and/or conventional combustion chamber. Using an internal chamber in addition to a typical barrel combustion chamber increases design flexibility of the munition. For example, the propellant can be varied in proportion between the barrel chamber and the internal chamber(s). Further, ignition of the propellant in the internal chamber(s) can be directly from the primer (see FIG. 1B), through the propellant (see FIG. 2B), or via staged ignition (via electronic, separate primer or other mechanism). For example, a primer may ignite the shell/case propellant (e.g., the conventional combustion chamber) that then separately ignites the propellant in the internal chamber of the disclosed projectile. With staged ignition, altering performance characteristics of the projectile through changes in linear or rotational speed is possible. Further, ignition timing of the propellant in the internal chamber, in relation to the shell/case propellant, can be changed. Additionally, a range of ignition locations with respect to the internal chamber propellant can be selected, which can affect the combustion characteristics and internal chamber pressure profile. FIG. 2B illustrates such an embodiment. FIG. 2B shows a similar projectile as that described in relation to FIG. 2A, but shows the projectile within a conventional shell. As another difference, the tails 220 are different in FIGS. 2A and 2B. Similar to FIG. 2A, the projectile 200 may sit within casing/shell 207, and casing head of shell 207 contains primer 252. Casing/shell 207 may be non-metallic (such as paper or plastic) or metallic. In one embodiment shell 207 is a 12 gauge cartridge. Bolt 205 is not shown in FIG. 2B as compared to FIG. 2A, but may still be utilized. Also, while only one primer 252 is shown in FIG. 2B, an additional primer, primer tube or other ignition source may also be directly is coupled to the propellant in the internal chamber of projectile 200 in some embodiments. Shell 207 also contains a conventional combustion chamber 212, which may or may not contain propellant. As a whole projectile 200 and shell 207 may be considered munition 260, which can be treated as a traditional munition in a barrel. Thus, munition 260 may comprise a first combustion chamber 212 behind the projectile and a second combustion chamber 210 inside the projectile. Rather than a simple bullet/payload being contained within the casing, the traditional bullet may be substituted by the disclosed projectile. Propellant may be placed within internal chamber 210 as well as conventional combustion chamber 212; thus, similar to standard munitions, propellant can be placed behind projectile 200 and in front of primer 252. In one embodiment, pressurization of the body by the higher internal pressure supports the structure against compression exerted by barrel pressure.

In some embodiments, the internal chamber may be passive, effectively working as a pressure accumulator. For example, the disclosed projectile may include an internal chamber but without propellant. In this embodiment, the internal chamber acts as an accumulator of pressure built by the propellant placed behind the projectile or in another internal chamber. This chamber may accumulate pressure from any source (for example pressure generated by combustion in the barrel or other active chambers) and may release such pressure when the environmental pressure on its outlets is lower than the accumulated pressure. Releasing the pressure from this internal chamber as barrel pressure drops will impart low forces, spin in this case, on the projectile, which may be desirable for certain applications.

As described above, a conventional cartridge locates a combustion chamber between a primer and the projectile, such that when the propellant in the combustion chamber ignites, the projectile is shot from the cartridge and through the barrel of a firearm. In contrast, the disclosed projectile has an internal chamber solely or in addition to an external combustion chamber. Utilizing an internal chamber provides many advantages. A projectile with an internal chamber that serves as a combustion chamber for the projectile adds significant flexibility to the projectile's internal, external, and terminal ballistics performance. For example, the disclosed projectile provides for increased pressure trace manipulation (e.g., pressure in the barrel behind the projectile as a function of time) for enhanced linear and/or angular acceleration. The disclosed projectile provides self-imparted spin that stabilizes the projectile for a wide range of calipers, including handguns, rifles, tanks, naval artillery, rail guns, etc. The disclosed projectile reduces barrel wear and is barrel service temperature for both smooth and rifled barrels. The disclosed projectile increases combustion efficiency through higher combustion pressures and better mixing. The projectile may be used for both shelled and caseless ammunition, as well as in smooth bore and rifled barrels. For example, in rifled barrels the disclosed projectile reduces friction and eliminates the need for mechanical engagement to impart spin on the projectile, thus prolonging the life of the rifled barrel. Moreover, in rifled barrels that are worn and no longer work for conventional projectiles, the disclosed projectile could be used to extend the operational period of the barrel. The projectile allows the combustion pressure within the projectile's internal chamber to be higher than the barrel pressure and the maximum barrel pressure. In some embodiments, the combustion pressure of the internal chamber may be over 2× times greater than the barrel pressure. Thus, the disclosed projectile reduces barrel wear and barrel operating temperatures in all types of barrels, in part based on the combustion being maintained within an internal chamber and the fact that the projectile does not require mechanical engagement with a bore of the barrel for rotation. In one embodiment, internal chamber pressure may be decoupled from the barrel pressure (e.g., the internal chamber can support combustion independent of barrel pressure) by flow throttling (e.g., restricting the exit of gases through the outlets via design of such outlets or by restricting flow against barrel). The disclosed internal chamber allows longer combustion durations, resulting in higher muzzle velocities for the same peak pressure as a conventional round. Likewise, the disclosed internal chamber provides for a more complete burn and a higher combustion efficiency, as a higher combustion pressure and temperature homogenization eliminates cold spots during combustion and more effectively burns the propellant. Higher combustion pressures and temperatures allow for use of propellants that might not be possible at conventional combustion pressures and temperatures. Other benefits may similarly be realized by one of ordinary skill in the art.

In general, the internal chamber design controls combustion duration, pressure, heat duration, heat addition profile, etc., all which govern the pressure trace inside the projectile and the barrel. In one embodiment, the projectile comprises only a single internal chamber. It may be located at substantially the rear or tail end of the projectile, substantially the middle portion of the projectile, or substantially the front or nose end of the projectile. In other embodiments, the location of the internal chamber may be along a majority or substantially all of the length of the projectile. In other embodiments, the projectile comprises a plurality of internal chambers. In other embodiments, an internal is chamber may comprise a plurality of compartments, each which may be connected and/or separate to the other compartments and effectively operate independently or in conjunction with other compartments. Each of the plurality of internal chambers may be physically connected or separated. In one embodiment, the projectile's internal chamber can be separated into a plurality of compartments (e.g., each compartment may be stacked and/or adjacent to each other like stacked tin cans), exhausting either via the same or different outlets. Or in other embodiments, the projectile can have a plurality of separate internal chambers (with each chamber having one or more compartments), exhausting either via the same or different outlets. In one embodiment, the chamber may be designed for high-pressure situations, such as internal combustion, and the compartment within the chamber may be designed to use the chamber's high-pressure capabilities but is not—by itself—configured to withstand high pressures. Thus, the internal compartments of a chamber may be designed to burst at a set pressure that is lower than the high-pressure limit of the internal chamber.

In one embodiment, the propellant in each of the separate internal chambers may be ignited separately and/or selectively by one or more methods such as, but not limited to, electric, chemical, heat, shock wave, pressure, etc. Chambers may ignite synchronously or in any specific staging (order and timing) depending on desired projectile characteristics. For example, different propellants or other forms of stored energy (such as compressed gas), can be stored in different chambers. One or more of the chambers may keep their respective propellant inert while other chamber(s) may be combusting. As another example, each compartment and/or chamber may be connected by a conduit or other device that selectively controls the combustion (or prevents combustion) of that particular chamber or compartment. As another example, each chamber may be made of a different exterior material that is more or less resistive to igniting. As yet another example, each internal chamber may be encased in a specific coating (e.g., some coatings are more ignitable than others or may have specific burn rates) that helps control the ignition timing of that chamber. The shape of the internal chamber (which affects the burn rate of the propellant) is also variable. In general, the more distance a chemical reaction has to travel to consume a propellant, the longer that reaction will take to consume the propellant. A long, small diameter chamber ignited from one end, for instance, will burn slower than a spherical one ignited in its center. Thus, the variations of the size, material, location, and is connection between the different internal chambers as well as combustion duration may lead to different ignition timing and combustion pressures. As another example, ignition may be direct (e.g., each chamber can be directly ignited from a separate/dedicated primer or electronically) or indirect (e.g., each chamber may be indirectly ignited from other primer ignited propellant or from any chosen source of ignition (pressure, shock, heat, etc.)). As still another example, propellants from inside and outside of a particular chamber may be kept separate by limiting the contact area between the chambers or by use of one-way valves on any exhaust nozzles. In general, by staging the timing of any and/or all gas expansion events within the chamber and by controlling flow on the outlets of the internal chamber, combustion pressure of each internal chamber can be controlled.

The internal chamber may be formed of various materials. For example, the disclosed projectile may utilize advanced materials that can withstand the pressures of internal propellant combustion while not compromising barrel/projectile tolerances. As an example, some or all of the projectile may use fiber reinforced composite tubing for decreased manufacturing costs and other ballistic requirements. The body of the projectile may be made from a first material and the internal chamber may be made of a second material. For example, the internal chamber may be made of a rigid material such as carbon fiber or high strength steel. As another example, the internal chamber may be deformable, that is the chamber may expand to fit the barrel and may be made of plastic resin, copper alloys, aluminum etc. A deformable chamber provides many advantages, such as being economic (e.g., less expensive) to manufacture and can rely on the barrel's inside walls to limit their expansion, and provide low friction with the barrel to keep the frictional forces acceptable.

For combustion to occur in the internal chamber, it should (directly or indirectly) include a propellant. Propellants are well known in the art, and may include gun powder, smokeless powder, and other ignitable substances, and for the purposes of this disclosure, may also include compressed gas (in any form). There are many variations to the properties of propellant. For example, propellants may have different burn rates or auto ignition temperatures. Any amount of propellant can be placed inside the chamber as long as the chamber can withstand the pressure created by the resultant combustion. By varying the amount of propellant and burn rate of the propellant in each chamber, a pressure trace curve (e.g., barrel pressure over time) with a more effective shape can be achieved. For unguided projectiles, propellants should be largely consumed while the projectile is still in the barrel. Thrust produced by the projectile's internal chamber outside of the barrel could result in lower accuracy due to asymmetric gas dispersion, although, in a rotating projectile, high spin self-corrects much or all of this effect. In one embodiment, by changing the shape, propellant and ignition timing of the propellant inside the projectile's internal chamber(s), the pressure trace can be manipulated to achieve the desired projectile performance.

In some embodiments, a single type of propellant is used in the internal chamber, while in other embodiments different propellants may be used to change and/or control the burn rate of the propellant and combustion of the propellant(s). Some propellants are more ignitable or have a lower ignition temperature than other propellants; the variations between propellants can be used to selectively control the ignition of separate chambers or compartments. In some embodiments, different propellants may be used in different chambers of the projectile to provide different burn rates and/or pressure charges at different times for the projectile. For example, a first chamber may comprise a first propellant that is configured to combust at a time t1 with a pressure p1 and a second chamber may comprise a second propellant that is configured to combust at a time t2 with a pressure p2. In some embodiments, times t1 and t2 may be substantially the same with different pressures p1 and p2, while in other embodiments times t1 and t2 may be different with substantially the same pressures p1 and p2. Of course, more than two chambers may be used with different combustion times and pressures. In one embodiment, the propellant burn rate may be adjusted by chamber sizes and shape (which manages flame and reaction paths), chamber wall heat losses, and venting losses. For a fixed propellant, combustion duration may be governed by combustion pressure seen by the propellant. In one embodiment, a series of chambers that contain from slow to fast reaction propellants may be ignited in sequence.

Propellants may have "fast" burn rates or "slow" burn rates, as is known in the art. In one embodiment, propellant placed in the internal chamber (such as chamber 110 or 210) can be chosen to have a slower burn rate than the propellant(s) located in the barrel chamber (such as chamber 212). The burn rate of propellants is a pressure dependent, highly unstable process that is determined by various local conditions as is known in the art. A slow heat release propellant may result in relatively low pressures, which results in low chemical efficiencies because a significant percentage of the propellant is not burned. "Slow" propellants (e.g., propellants that take a long time to burn) are is especially sensitive to pressure reversals, mostly halting combustion after peak pressure has been achieved. A further complication of using slow propellants in the barrel is that extended combustion times and low pressures can lead to unburned clusters of the propellant igniting towards the end of the combustion cycle, producing a characteristic double humped pressure trace that can lead to barrel failure. However, with the disclosed internal chamber, pressure inside the internal chamber can be maintained by controlling the flow through the outlets, independent of the projectile's position in the barrel and largely independent of barrel pressure. When deflagrating (subsonic) behavior is expected, the ignition sites of the propellant need to be considered carefully. Prolonging high pressures and temperatures may be preferred in this disclosure, as it is a primary way of obtaining higher than conventional muzzle velocities for a given projectile weight and barrel pressure limit. Prolonged high pressures can also result in higher energy input to rotation. In one embodiment, placement of the ignition sites as close as possible to one another, blending their reaction fronts early (or if staged ignition is used, timed precisely), increases the safety and efficiency of the projectile.

The selective ignition of different internal chambers provides many advantages. For example, selectable ignition by dividing the internal chamber into different compartments and/or having a plurality of internal chambers provides design variations to linear and/or rotational speed magnitudes for the projectile. Selective rotational speed of a shot dispersing round can govern the distance at which desired shot scattering is achieved, thereby giving more control to the operator and covering a range of distances with a single type of ammunition. Different internal chambers allow operators to customize barrel pressure profile to meet desired projectile characteristics such as terminal ballistics or heat/sound signature criteria. Through use of multiple internal chambers operator can use variety of propellants, different timing of ignition and ignition source, different projectile materials and different internal chamber design to manipulate pressure and flame fronts, for example.

Figure 3A:
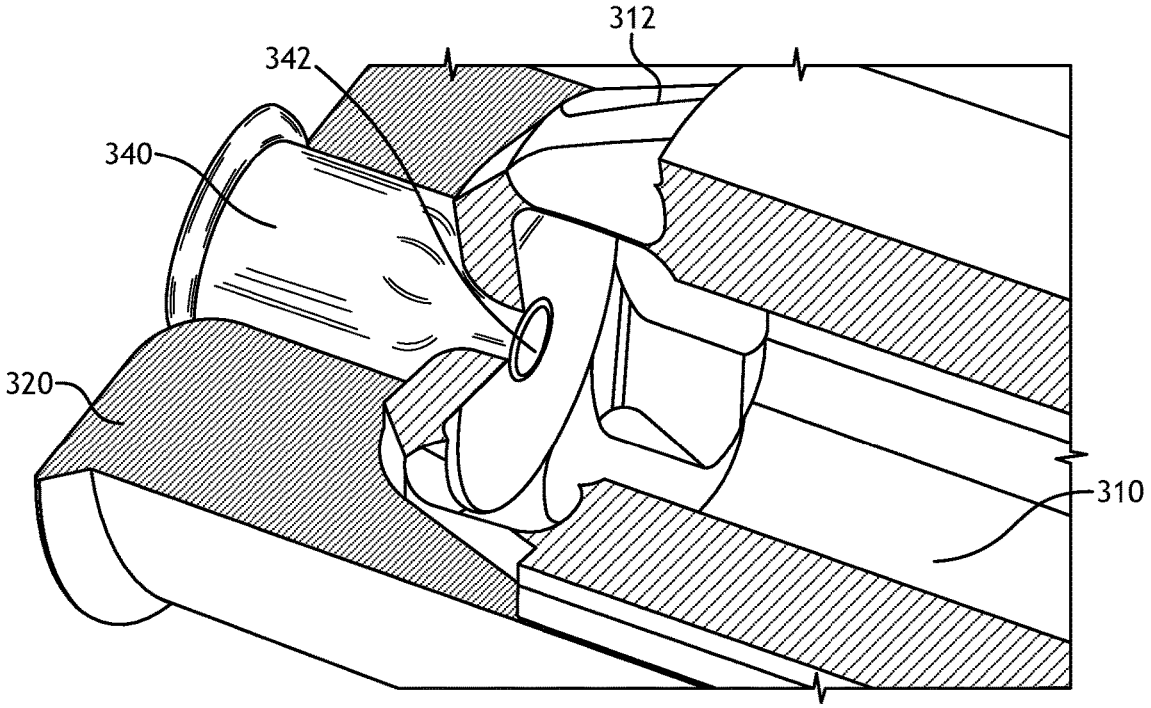
FIG. 3A is an illustration of an ignition mechanism for a projectile according to one embodiment of the present disclosure.
Figure 3B:
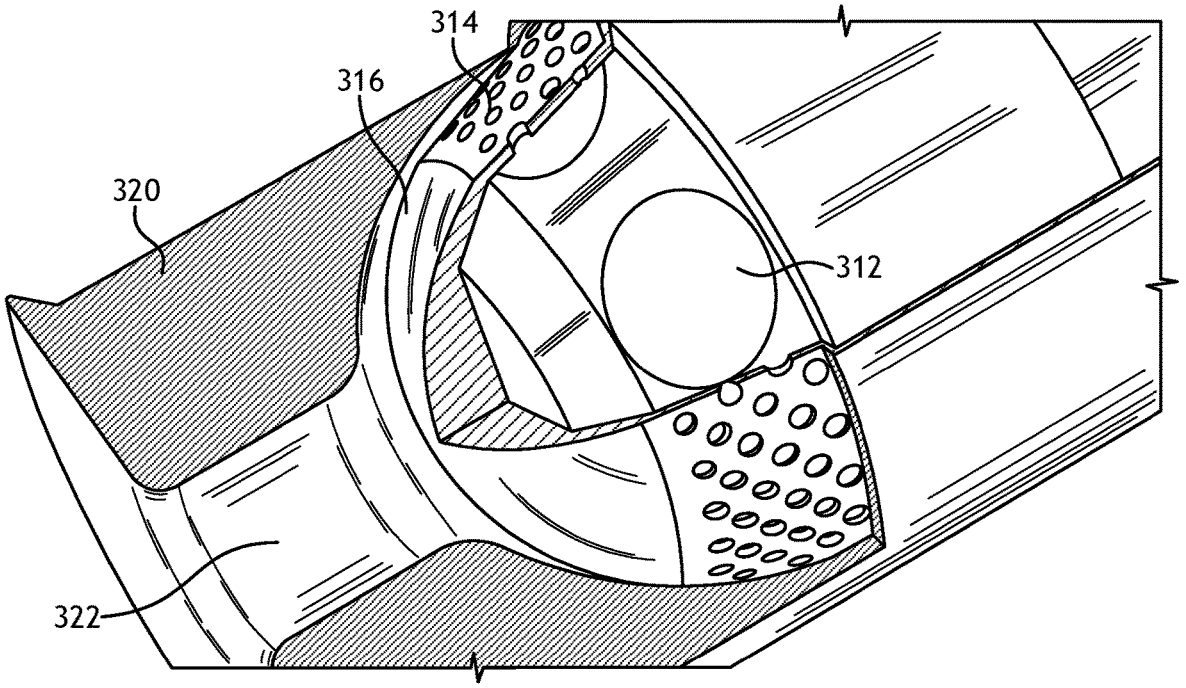
FIG. 3B is an illustration of an ignition mechanism for a projectile according to one embodiment of the present disclosure.

The internal chamber and/or propellant within the internal chamber can be directly or indirectly ignited. For example, a primer may be directly coupled to internal chamber 110 by placing the primer in direct communication with the internal compartment of the internal chamber. As another example, the internal chamber may be indirectly ignited by igniting a separate propellant that then ignites the propellant within the internal is chamber or by other deliberate and timed exposure to heat, pressure, shock, chemical or other known and used ignition type. Ignition timing of the internal chamber's propellant is critical to achieve the desired ballistics and results of the projectile. FIGS. 3A and 3B illustrate various ignition mechanisms for the disclosed projectile. FIG. 3A illustrates primer 340 situated in case 320 and directly coupled to internal chamber 310 via primer extension 342, while FIG. 3B illustrates the primer directly coupled to the nozzles 312. FIG. 3B discloses a projectile seated on a shell receptor base 316 that contains openings 314 to allow the flame front to reach the propellant in the internal chamber. The shell receptor base 316 directly couples the shell's primer (not shown in FIG. 3B, but normally seated in case head aperture 322) to the projectile's nozzles 312.

In one embodiment, a standard ignition sequence of the projectile illustrated in FIG. 2B is described below. A primer (such as primer 252) ignites when struck by a firing pin from a firearm, which then ignites the propellant in combustion chamber 212. This ignition raises the pressure and temperature in combustion chamber 212 higher than that of internal chamber 210, with the hot gasses produced by both ignitions entering internal chamber 210. The flame front may travel through outlets 222 to ignite the propellant inside internal chamber 210. Consumption of the propellant contained within internal chamber 210 results in gas generation that vents through any outlets (such as nozzles 222) once the pressure inside the projectile is higher than the pressure outside it. If the nozzles are placed in a tangential manner, torque will be developed.

In one embodiment internal chamber 110 is coupled to one or more outlets or nozzles 112. For that internal chamber, outlets 112 are necessary to discharge the combustion pressure/gasses from the projectile as well as to allow for ignition. Such exhaust discharge may be configured to impart linear acceleration and/or angular acceleration (e.g., self imposed spin) to the projectile. Outlets 112 may take a variety of shapes and be coupled to the internal chamber at a variety of different locations. In one embodiment, one or more outlets may be located on a rear section of the internal chamber, on one or more sides of the internal chamber, or a forward section of the internal chamber. Similarly, one or more outlets may be located on a rear section of the projectile, on one or more sides of the projectile, or a forward section of the projectile. In one embodiment, the internal chamber forms an exterior portion of the projectile body, such that one or more of outlets 112 may directly exhaust from the internal chamber to the exterior of the projectile. In other embodiments, the internal chamber forms an interior portion of the projectile, such that an exterior portion of the projectile body may have one or more outlets that are coupled to one or more outlets of the internal chamber. If multiple internal chambers or compartments are utilized, each of the internal chambers may have separate outlets or one or more outlets may be coupled to all of the separate internal chambers. By adjusting the outlet size and shape, mass flow and projectile mass distribution, the desired rotational speed can be achieved for the projectile. In one embodiment, rotation direction, i.e., clockwise or anti-clockwise, can be chosen by changing nozzle orientation. In one embodiment, each of the plurality of outlets is adaptive, such that the outlet size and/or shape may be varied either mechanically (such as by springs) or electronically for selective control of chamber pressure and/or gas flow. In still other embodiments, the projectile may comprise a turbine (such as an axial, centrifugal, hybrid, or otherwise) that converts pressure from at least one chamber to angular acceleration for the projectile.

Outlets 112 may each have substantially the same geometric shape and/or size or each of a plurality of outlets 112 may have different shapes and/or sizes. The shape of the outlets influences the amount and type of thrust produced on the projectile. In one embodiment, one or more outlets 112 comprise one or more nozzles. For example, as shown in FIG. 1B, the plurality of outlets may comprise a plurality of radially placed, tangential nozzles coupled to the internal chamber 110. Each nozzle comprises a substantially circular shaped opening. Any outlet shape is possible, such as non-circular, slanted, grooved, and other shaped openings. Outlets may comprise of nozzles, apertures, fins/blades or other common components that define exhaust geometry and thus the magnitude, type and duration of thrust produced. Outlets 112 may be substantially open or have a mesh or grid type structure such that each exhaust outlet comprises a plurality of outlet openings, much like a showerhead nozzle. The outlets may be oriented at particular directions and/or orientation to provide the desired forces on the projectile. For example, the plurality of outlets 112 may be slightly angled from each other and/or offset from the axis of rotation to exert rotational thrust to the projectile. Similarly, if the plurality of outlets 112 are slightly angled towards the rear of the projectile they may be configured to create additional forward thrust to the projectile. The placement of the outlets 112 in FIG. 1B provides linear and rotational acceleration to the projectile, by creating both linear motion and spin to the projectile from a barrel regardless of the existence of any grooves or rifling is within the bore of the barrel. Of course, the placement and orientation of the outlets is variable based on propellant choice, projectile shape and size and the desired internal and external ballistics. Projectile configuration and shape will depend on desired outlet shape and size. FIG. 1B shows that the projectile body itself has a plurality of openings 112 near the tail end of the projectile to exhaust gas from the internal chamber. Exhaust outlets 112 are fluidly coupled to chamber outlets 112. Exhaust outlets 112 are needed because internal chamber 110 is internal to body 101 of the projectile, thereby requiring an external portion of the body to release the combustion gas and pressure. In one embodiment, the plurality of exhaust nozzles may comprise one-way valves to limit intake of other gas and to keep the respective chamber selectively ignitable at the desired time/occurrence. Outlets are designed to exhaust internal chamber pressure, but can also be used as an ignition aperture. As such, variable geometry (of any implementation type) may be used to accommodate these functions or to alter dynamic performance during thrust generation.

The exhaust outlets may be located substantially at a rear or tail end of the projectile, at a middle portion of the projectile, or at a nose or front end of the projectile (or a majority or substantially all of the entire length of the projectile), In one embodiment, tail section 120 of projectile 100 comprises exhaust outlets 112. Exhaust outlets 112 may be situated on one or more sides of the projectile and/or at substantially an end of the projectile. In one embodiment, a first internal chamber may be coupled to a first plurality of exhaust body openings oriented in a first direction and a second internal chamber may be coupled to a second plurality of exhaust outlets oriented in a second direction; in this embodiment, the different internal chambers can be selectively ignited to impart different linear and/or angular accelerations to the projectile at different times. Thus, based on the configuration of the outlets and/or tail (as well as the internal chamber(s) and propellant(s)), the rotational speed and/or rotational direction of the projectile can be varied. In other words, the size and positioning of nozzles, the amount and type of propellant, and internal chamber shape and size can be manipulated to alter the projectile's angular and muzzle velocity based on the desired performance capabilities.

In another embodiment, the tail and/or outlets is/are configured to throttle and/or choke exhausted gas flow between a projectile's chamber and the barrel, thereby increasing pressure in that chamber. In general, flow throttling occurs when the projectile's outlets are small enough to prevent the pressure of the internal chamber from is rapidly decreasing to the environmental pressure levels (barrel pressure, during internal ballistics), In one embodiment, where high torque exertion to the projectile is desired, exhaust outlets should have the largest possible offset from the axis of rotation to maximize torque. Adequate outlet area may be provided to create substantial pressure thrust and/or to avoid excessive choking of the gas flow through the nozzles. In one embodiment, the barrel is used as a blast deflector for the exhausted gas, allowing for local high pressures to be generated by low gas flow. By directing the outlet against this baffle, working exhaust pressure becomes considerably higher than barrel pressure. In this case, flow is not restricted by outlet diameter, but in the constriction channel (throat) between the outlet(s) and the barrel. Throttling the flow may decouple projectile chamber pressure and burn time from barrel pressure. Further, by having the constriction after the outlet, the outlet mouth(s) may be wider, distributing (over a larger outlet area) pressure that is locally higher than the corresponding average barrel pressure. Thus, a "throttled" nozzle produces higher-pressure torque. With only a "free flowing" nozzle, e.g., one not constricted against the barrel, a large percentage of pressure torque is lost. In a "free flowing" nozzle example, the nozzle jets are working against the local pressure drop of the vortex behind the projectile. This outlet pressure is lower than average barrel pressure and produces a fraction of the thrust of a baffled outlet.

Various shapes of the projectile are possible within the scope of the present disclosure. In one embodiment, a tail section (whether part of the body or otherwise attached) increases the flexibility of placement and orientation of the outlets on the projectile. The disclosed projectile's tail can be designed according to any requirements of the projectile and projectile ballistics, such as increased/decreased drag, exhaust outlet throttling and/or choking, internal chamber ignition (or timing thereof), sealing, linear or rotational acceleration, propellant compatibility, etc. In one embodiment, the rear part can be boat-tailed to decrease drag without significantly affecting the functionality of the projectile. In one embodiment, the rear part is shaped such that any outlets or nozzles on the tail are positioned at a wide offset to increase torque exertion on the projectile. Additionally, drag can be adapted for different implementations. In cases of marginal stabilization a high drag tail may help secure the projectile by placing the center of drag in a more advantageous position relative to the center of mass. While having a tail section is often desirable to achieve certain ballistic characteristics as described herein, a tail section is not required for is all embodiments.

Figure 4:
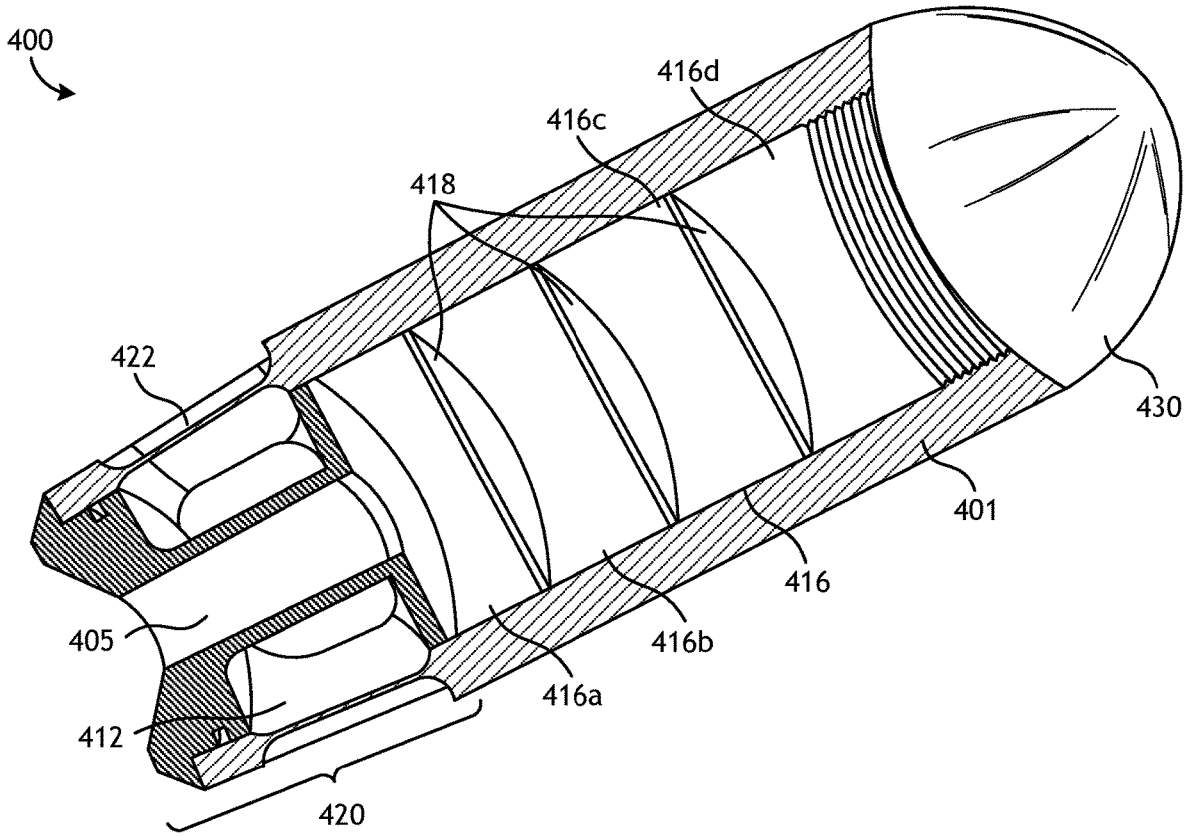
FIG. 4 is an illustration of a projectile according to one embodiment of the present disclosure.

As described herein, the disclosed projectile allows a wide variety of combinations of multiple chambers and/or compartments, including for multiple purposes. Another embodiment of a projectile is described in FIG. 4, which may be substantially similar to FIGS. 1A and 2B but comprises multiple chambers and compartments. In one embodiment, projectile 400 comprises nose 430, body 401, and tail 420. Projectile 400 may also have a plurality of internal chambers, such as first chamber 412 and second chamber 416. In one embodiment, chamber 416 may be divided into separate compartments 416*a*-416*d* by separators 418. In one embodiment, chamber 412 is configured to create rotational force (for spin) for the projectile and chamber 416 is configured to create linear acceleration for velocity (e.g., thrust) for the projectile. For example, the gas from combustion in first chamber 412 may exhaust via outlets 422 to create rotational force. At or near the same time or at a different time, the gas from compartments 416*a*-416*d* exhaust from outlet 405 in tail 420. The propellant in each chamber and/or each compartment may be the same or different depending on the desired combustion properties and pressure trace. Separators 418 may be made of any material (e.g., plastic, metal, etc.) or may represent a transition from one propellant to another without any physical divider (e.g., propellant layering). In one embodiment, separators 418 are designed to control accidental ignition of the chambers and will break upon combustion inside the relevant compartment. First chamber 412 and second chamber 416 may have the same ignition source and timing and/or different sources and timing. Similarly, within second chamber 416, each compartment may have different ignition sources and/or different timings.

Figure 5A:
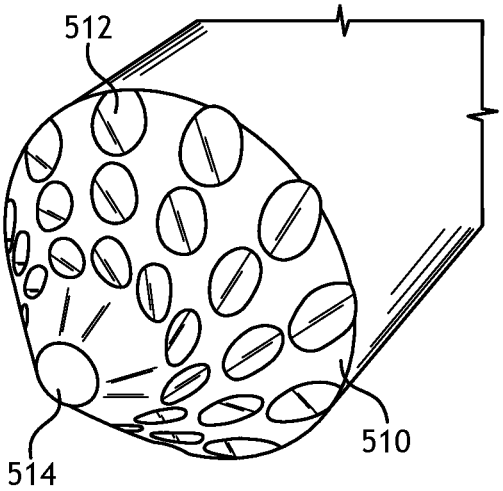
FIG. 5A is an illustration of one embodiment of a projectile tail according to one embodiment of the present disclosure.
Figure 5B:
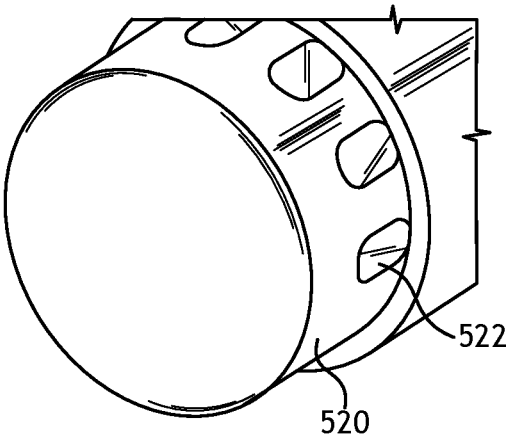
FIG. 5B is an illustration of one embodiment of a projectile tail according to one embodiment of the present disclosure.
Figure 5C:
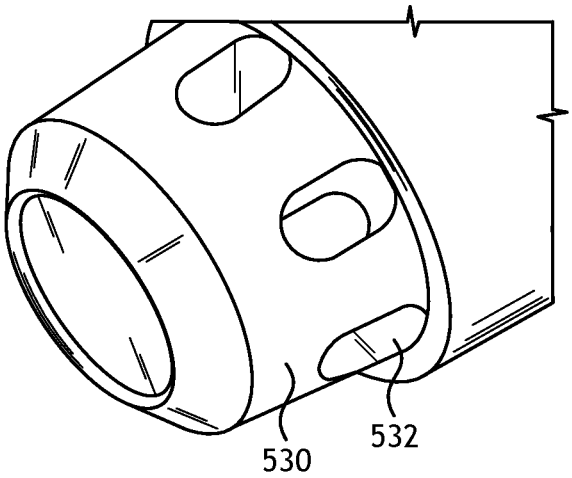
FIG. 5C is an illustration of one embodiment of a projectile tail according to one embodiment of the present disclosure.

A wide variety of tails 120 can be utilized with the disclosed projectile. In one embodiment, the projectile's tail may be of almost any shape. For example, a tail that is cylindrical and coaxial to the barrel might be appropriate for a particular application. For other applications, the tail may be aggressively conical (e.g., high angle cone), but that may produce less torque. In general, low angle cones seem to best suited in terms of nozzle efficiency (in rotational terms) and aerodynamic drag reduction (in translational terms) for most ballistic trajectories. For example, tail 120 in FIG. 1B has a conical shape with a substantially rounded end. FIGS. 5A-5C disclose other variations of a tail that may be used with the disclosed projectile. FIG. 5A shows a conical shaped tail 510 with a substantially flat end 514 with different sized exhaust nozzles 512 placed radially around the tail. FIG. 5B shows a substantially cylindrical shaped tail 520 with a plurality of is similarly sized exhaust outlets 522 placed radially around the tail. Similarly, 5C shows a low angle cone shaped tail 530 with a plurality of similarly sized exhaust outlets 532 placed radially around the tail.

Figure 6A:
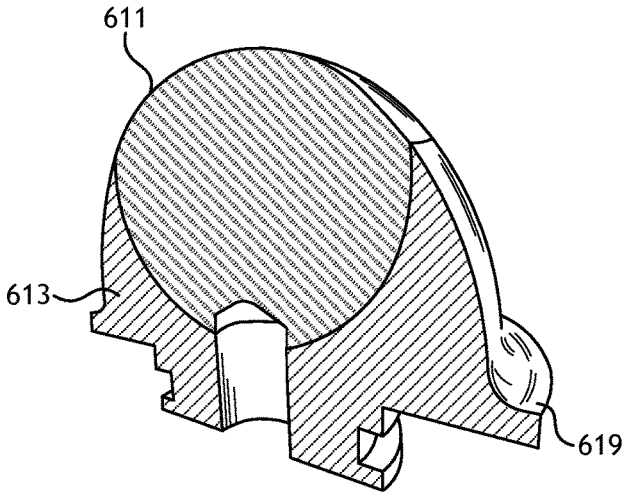
FIG. 6A is an illustration of one embodiment of a projectile nose according to one embodiment of the present disclosure.
Figure 6B:
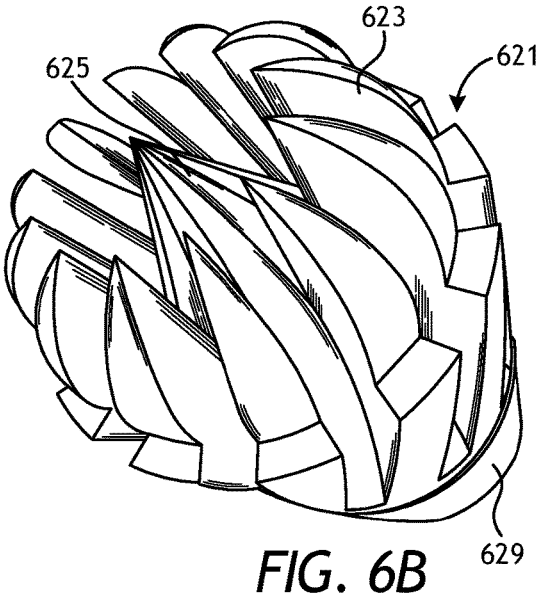
FIG. 6B is an illustration of one embodiment of a projectile nose according to one embodiment of the present disclosure.

A wide variety of heads/noses 130 can be utilized with the disclosed projectile. In one embodiment, low drag noses may be used, such as elastically/plastically deformable noses, serrated noses, hollow point noses, bumper ring noses, etc. For example, nose 130 in FIG. 1B has a conical shape with a substantially pointed end. In other embodiments, the nose can be substantially spherical, substantially rounded, and/or have a substantially rounded end or substantially flat. FIGS. 6A and 6B disclose other variations of a nose that may be used with the disclosed projectile. For example, FIG. 6A shows spherical rubber nose 611 coupled to nose base 613. The nose rim 619, at the widest part of the nose base is where the shell rim rests on. As shown in FIG. 6A, a bolt may be used hold the rubber nose in place. FIG. 6B shows serrated nose 621 with multiple serrations 623. Each serration 623 reduces frontal area minimizing aerodynamic drag. Further, the center of the nose may comprise a conical tip 625 that may be in front of, level with or below the serrated ring surrounding it, for aerodynamic and terminal ballistics optimization. The serrated nose in FIG. 6B may serve to lower drag (such as in shotgun slugs) and to avoid accidental ignition of the primers of other munitions (discussed below). In one embodiment, serrating the nose rim may improve aerodynamics of the projectile (such as by 30% or more) and provides torque to keep the projectile rotating at high speed via torque generated through aerodynamic drag of the serrations. One such hollow point bullet and method of making same is disclosed in U.S. Publication No. 2006/0144280, incorporated herein by reference. Each of the noses shown in FIGS. 6A and 6B comprise a rim 619 or serrated rim 621 for the shell's ammunition sleeve to roll onto, thereby securing the projectile to the shell.

Figure 6C:
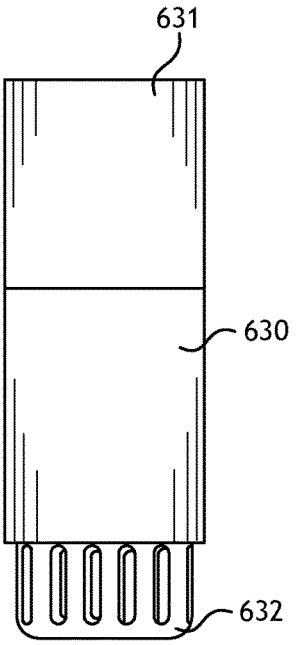
FIG. 6C is an illustration of a projectile according to one embodiment of the present disclosure.
Figure 6D:
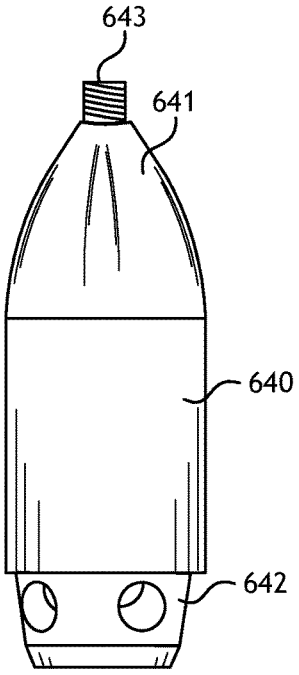
FIG. 6D is an illustration of a projectile according to one embodiment of the present disclosure.
Figure 6E:
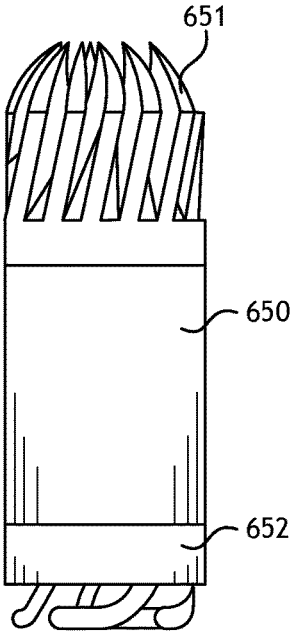
FIG. 6E is an illustration of a projectile according to one embodiment of the present disclosure.

Other shaped noses, tails, and projectiles are also possible, illustrating the high level of modularity of the components and the disclosed projectile. For example, FIGS. 6C-6E show various projectiles with different shaped noses, rear parts with exhaust nozzles and different projectile lengths. These projectiles may be inserted into a barrel by themselves and directly shot by the firearm or may be inserted into a case or shell (such as that described in relation to FIGS. 1A and 2B) for firing from a firearm. For example, FIG. 6C shows a projectile with a substantially cylindrical body 630 and a substantially is cylindrical nose 631. Nose 631 has a substantially flat shape, which increases the drag of the projectile, which may be useful for some applications. Tail 632 is substantially cylindrical with grooved/elongated outlets. As another example, FIG. 6D shows a projectile with a substantially cylindrical body 640 and a rounded/semi-spherical nose 641. Protruding from nose 641 is a threaded bolt 643, which may be useful for securing the nose and/or for terminal ballistics performance. Tail 642 is slightly angled with circular outlets. As another example, FIG. 6E shows a projectile with a substantially cylindrical body 650 and a serrated nose 651. Tail 652 illustrates an axial/centrifugal hybrid type turbine outlet. In one embodiment, each of the bodies 630, 640, and 650 are substantially similar, and different tails and noses may be attached to the body to form different projectiles for different applications. Of course, in other embodiments, different sized bodies can be used as well.

In other embodiments, the nose may be configured for safe and efficient inline stacking of centerfire cartridges, such as in tubular magazines. For example, tubular magazines are the norm for shotguns, but present a problem when stacking projectiles that protrude from the corresponding shell. Vibrational or impact shock from firing a round in the chamber, dropping the gun or other sources, might cause the nose of one projectile to set off the primer of the shell sitting in front of it. In one embodiment (as shown in FIGS. 6A and 6B), a nose with an elastic tip or with the tip sitting behind or flat with a "ring" (serrated or otherwise) larger than the maximum outer diameter of the primer (such as 8 mm for a 12 Gauge ammunition) may be used. This shaped nose also provides superior external ballistics because of its low drag. Because the tip of the round (e.g., the nose) may protrude from the cartridge shell, this projectile allows for shorter cartridge lengths thereby permitting higher capacities from the same tubular magazine.

Sealing of the projectile relative to the barrel is also an important design factor. A sealing element helps to prevent substantial amounts of combustion pressure from exiting through unintended places around the projectile that would cause unwanted pressure leakage and decrease efficiencies. Any sealing element helps to minimize blow-by. In some embodiments, a seal between the projectile and the barrel helps direct the exhaust gases in the direction required for the intended ignition sequence and/or angular and linear acceleration of the projectile. In one embodiment, the seal may be placed ahead of the internal chamber and/or outlets which drastically increases the projectile's chamber service is pressure, effectively subtracting barrel pressure from pressure acting on the inside chamber walls during combustion. Assuming an internal chamber with a pressure limit as high as the pressure limit of the barrel, the internal chamber can operate at an absolute pressure up to two times the pressure limit of the barrel (i.e. the weapon in which that projectile is used). In the embodiments shown in FIGS. 7A (after seal is inflated), 7B, 7C, and 7D, only the pressure differential between the internal chamber and the barrel acts on the internal chamber. Whether the ignition is direct or indirect can and may affect the sealing element and effects of the seal. For example, sealing for indirect ignition can provide a delay in pressure rise, after ignition of the main charge. In direct ignition, almost any type of conventional sealing is suitable.

Figure 7A:
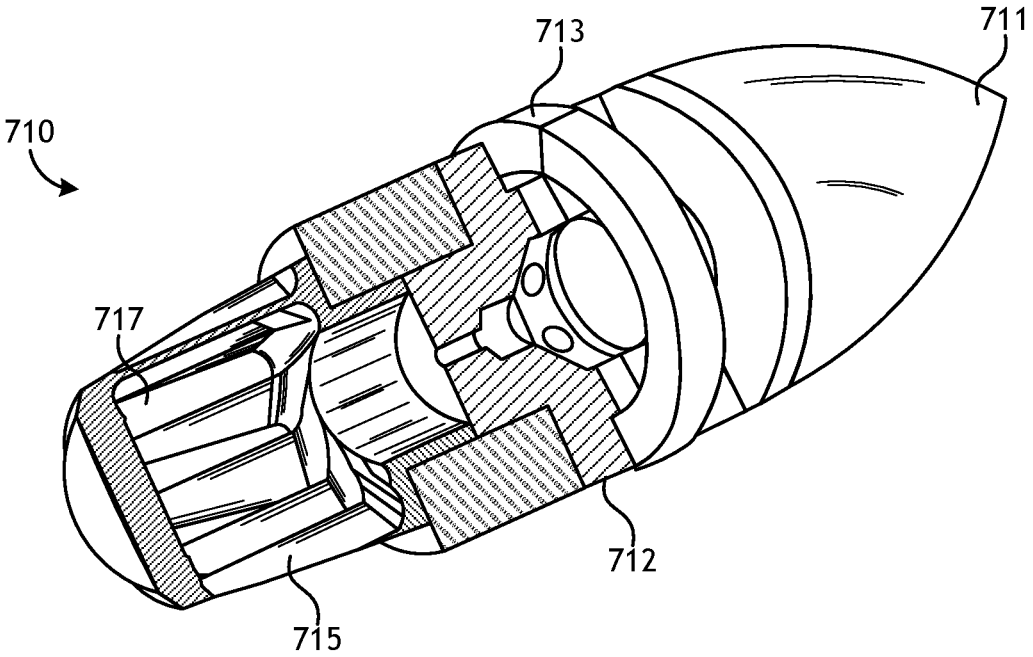
FIG. 7A is an illustration of a projectile according to one embodiment of the present disclosure.

An inflatable sealing ring may be used that allows for variable timing of inflation of the sealing ring through inlet/outlet and expansion chamber sizing. For example, FIG. 7A shows projectile 710 with a nose section 711, a body 712, a tail section 715, a plurality of exhaust outlets 717, an internal chamber within the body and an inflatable seal 713. The shape of tail 715 is slightly angled, and each of the exhaust outlets 717 has a grooved structure over a longitudinal length of the rear part. An inflatable sealing ring may sit deflated on the projectile and thus allow initial blow by on startup. This provides the primer ignited propellant placed behind the projectile time to ignite the internal chamber propellant and/or a delay in barrel pressure rise after ignition of the primer until a defined rise inside the internal chamber occurs. In one embodiment the seal expands when approximately ⅓ of the propellant has combusted (before 50% mass fraction burn) so that a high pressure profile can be achieved. In cases of indirect ignition, delays of the pressure rise due to combustion of the shells charge generally decrease the chance of a misfire and allow greater combustion efficiency of the internal chamber propellant with higher pressures. In one embodiment, sealing that allows projectile expansion without leakage or excessive friction generation can also be used, similar to using a sabot (see, e.g., FIG. 8A).

Figure 7B:
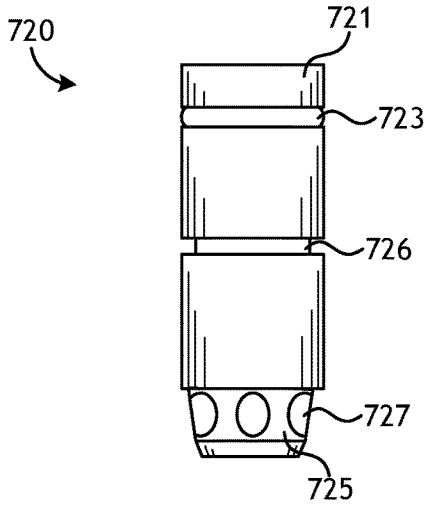
FIG. 7B is an illustration of a projectile according to one embodiment of the present disclosure.
Figure 7C:
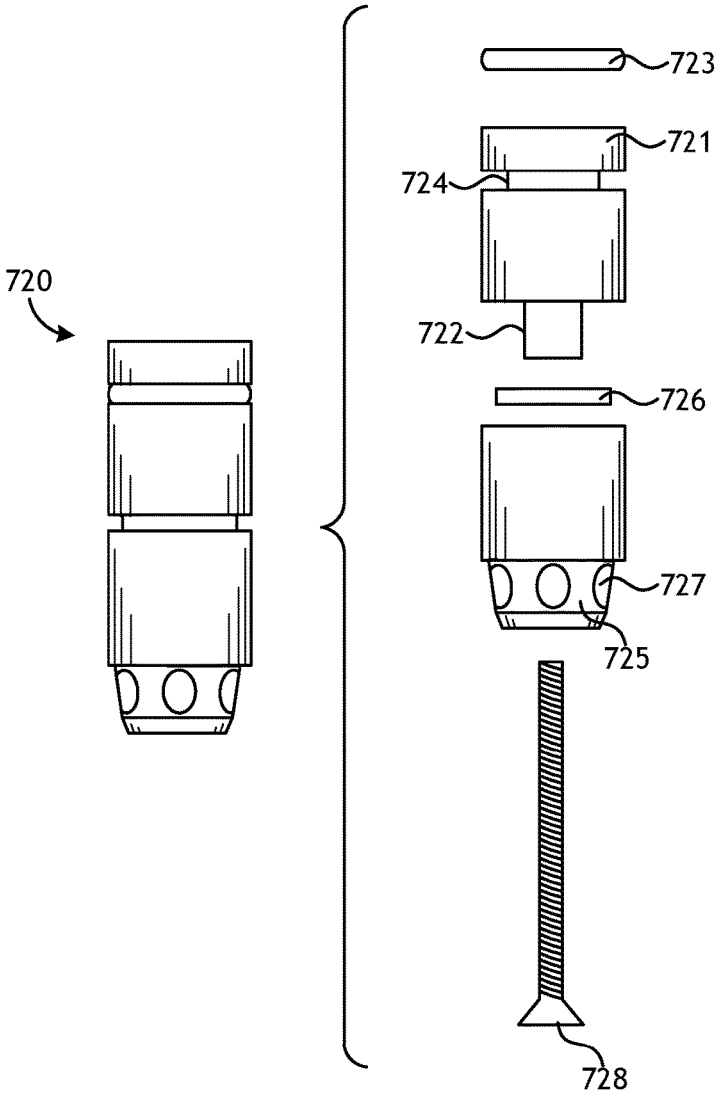
FIG. 7C is an exploded view of the components of the projectile described in FIG. 7B.
Figure 7D:
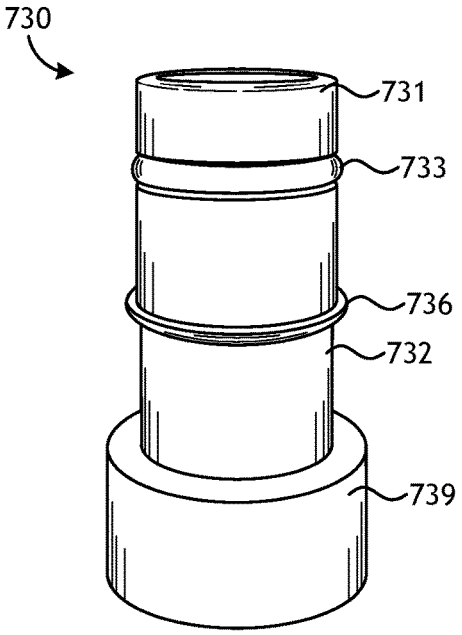
FIG. 7D is an illustration of a projectile according to one embodiment of the present disclosure.

In some embodiments, as shown in FIGS. 7B-7D, an outer surface of the projectile may be coupled to one or more sealing elements. FIG. 7B shows projectile 720 with a nose section 721, a tail section 725, a plurality of exhaust outlets 727, an internal chamber within the body and seals 723 and 726. In one embodiment, sealing element 723 may be an O-ring that sits within a corresponding groove, or adjustable groove, on the is exterior portion of body 721 or between different parts as in FIG. 7D. Other sealing elements may also be used, such as a gland, a bourrelet, a rotating or driving band, or an inflatable sealing ring. The body of the projectile may be formed by connecting nose 721 with tail 725. A plurality of exhaust outlets 727 are formed within and/or coupled to tail 725. The shape of tail 725 is slightly angled, and each of the exhaust outlets 727 has a substantially cylindrical and/or circular shape. FIG. 7C is an exploded view of the components of projectile 720 described in FIG. 7B. A portion of the projectile's body includes a recessed groove 724 that is sized for O-ring 723 to fit within the groove. A seal/spacer 726 is placed between projectile components and its preload compression to be adjusted. Guide 722 is used to couple the nose or front body portion of the projectile to the body or rear portion of the projectile. In one embodiment, bolt 728 may be used to couple the tail and nose portions of the projectile together, and may be threaded into guide 722 (which may have corresponding threads to receive bolt 728). In other embodiments, a clutch might be needed between the outlets and projectile components with high moment of inertia (such as the nose) to stop them from slipping across each other, for torque transmission, which may be used alternatively or in addition to a seal. For example, FIG. 7D is an illustration of a projectile according to one embodiment of the present disclosure that uses a clutch, such as seal/clutch 736. Projectile 730 comprises nose 731, body 732, a first sealing element 733, a second sealing element 736, and loading base 739. Sealing elements 733 and/or 736 may comprise an O-ring in one embodiment. In this embodiment, the projectile combines the sealing element (such as an O-ring) and a clutch into one integrated component, as shown in FIG. 7D as element 736.

In one embodiment, the disclosed projectile provides an inbuilt pressure limiting safety feature. For example, if the barrel or another component safety (whether the projectile or a component of the firearm) is of concern due to the potentially high internal pressures, projectiles can be designed such that a projectile's component fails at a designed pressure limit, thereby reducing pressure before critical barrel pressure is reached. One such safety mechanism can be achieved through the yield limits on the threads or bolt holding the nose to the projectile. For example, for a 12 gauge slug example, a metric M4×0.7 bolt, 10.9 grade, designed to fail at 1350 bar may be used. This corresponds to a barrel pressure of less than 1100 bar, since barrel pressure is lower than internal chamber pressure when propellant inside the chamber is combusting. This is comfortably under the proof pressure of a 3" magnum barrel, inline with current market is practice, and protects the shooter against unforeseen circumstances. In one embodiment, the internal chamber design may consist of a weak link (such as a bolt) that yields at a set pressure. This pressure is chosen to be below the barrel pressure limit and thus the barrel is protected from overpressure of the internal chamber within the projectile within the barrel. If the projectile expands too much and gets stuck (or the internal chamber pressure increases beyond designated pressure), the bolt will break and the nose will fall off (e.g., the nose shoots away from the projectile based on pressure) thereby releasing any internal chamber pressure causing the blockage. Besides a bolt, other components may similarly be designed to fail at a preset pressure limit, such as any fasteners, perimetric fasteners, valves, diaphragms, bulkheads, separators, etc.

Figure 8A:
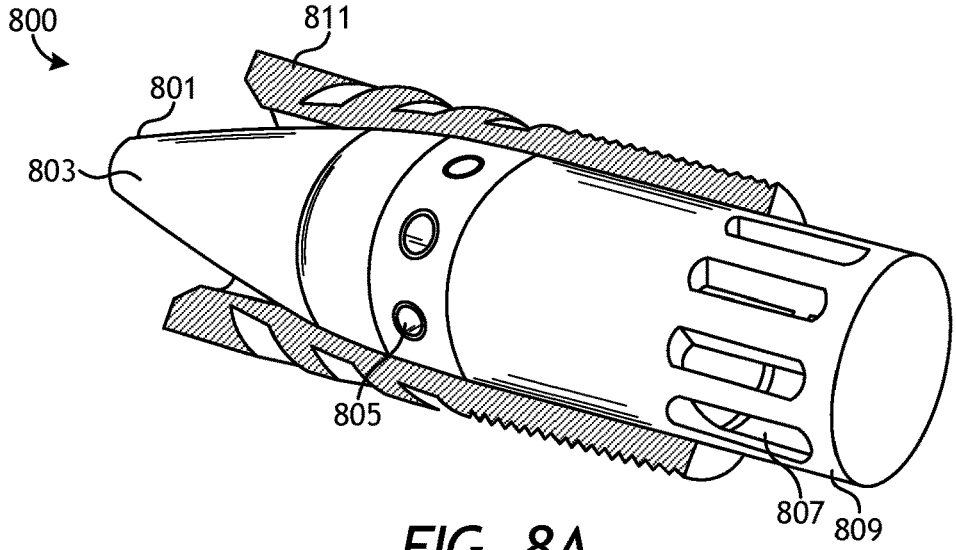
FIG. 8A is an illustration of a projectile within a sabot according to one embodiment of the present disclosure.
Figure 8B:
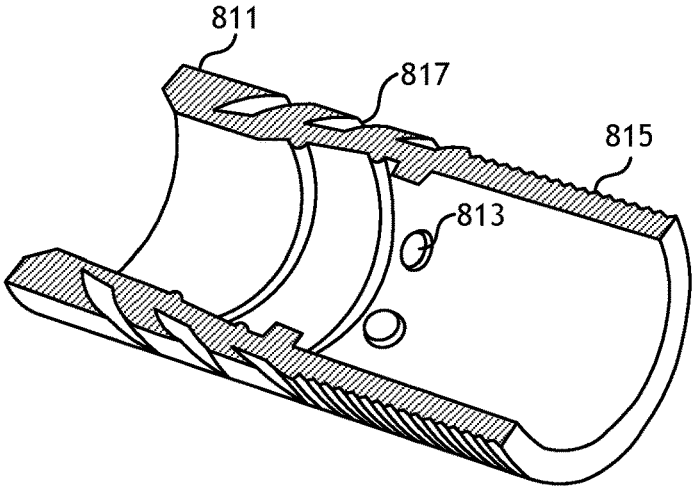
FIG. 8B is an illustration of the sabot (without the projectile) from FIG. 8A.

In one embodiment, the disclosed projectile may be utilized with a sabot. A sabot is a structural device used with an ammunition to help keep the projectile in the center of a barrel, particularly when the ammunition and/or projectile has a substantially smaller diameter than the bore diameter of the barrel. FIG. 8A shows one example of a disclosed sabot projectile system 800 with projectile 801 coupled to sabot 811 according to one embodiment of the present disclosure. FIG. 8B is an illustration of the sabot (without the projectile) from FIG. 8A. Projectile 801 comprises at least one internal chamber (not shown) with a first plurality of ejector openings 805 radially dispersed around an exterior of the projectile and located at a first longitudinal location on the projectile's body and a plurality of outlets 807 located at a second longitudinal location on the projectile's body. In one embodiment, each of the first plurality of openings 805 is substantially circular and are configured to couple to corresponding protrusions 813 on the inside surface of sabot 811. The interaction of ejector holes 805 and protrusions 813 help keep the sabot coupled to the projectile while in the shell and barrel, doubling as sabot securing pins. In one embodiment, the plurality of outlets 807 are substantially grooved or elongated, and may be located outside of the sabot 811. The projectile may have a front or nose section 803 that extends partially outside of sabot 811 and a rear or tail section 809 that also extends partially outside of sabot 811, which allows the exhaust outlets 807 to extend from the sabot and operate as intended. In this embodiment, sabot 811 is made of a deformable material and radially surrounds a substantial portion of projectile 801 (e.g., spool type sabot). An exterior portion of sabot 811 may include high pressure sealing grooves or ridges 815 and low pressure sealing concentric expandable grooves 817, which allow for barrel pressure sealing while is enabling the projectile to rotate with minimal friction. In one embodiment, the deformable sabot allows for large expansion of the internal chamber without compromising the dimensional tolerancing between projectile and barrel. With a deformable sabot, the internal chamber may be made from common materials, such as plastic, aluminum, copper and lead alloys. In one embodiment, there is enough residual pressure to discard the sabot from the projectile upon muzzle exit by providing feeding channels from the internal chamber (or directly from the barrel) to ejection outlets 805. The disclosed sabot/projectile combination will achieve (and sustain for longer) higher speeds, while at the same time keeping barrel pressures reasonable. The use of the disclosed projectile with the deformable sabot is superior than conventional uses of a sabot. For example, currently, small caliber sabots allow aerodynamic drag to separate the sabot from the projectile (which disturbs the flight path), and large caliber sabots rely on expensive dedicated explosives for sabot separation. In one embodiment, an internal combustion chamber as disclosed herein may serve as a sabot separator driver.

Figure 8C:
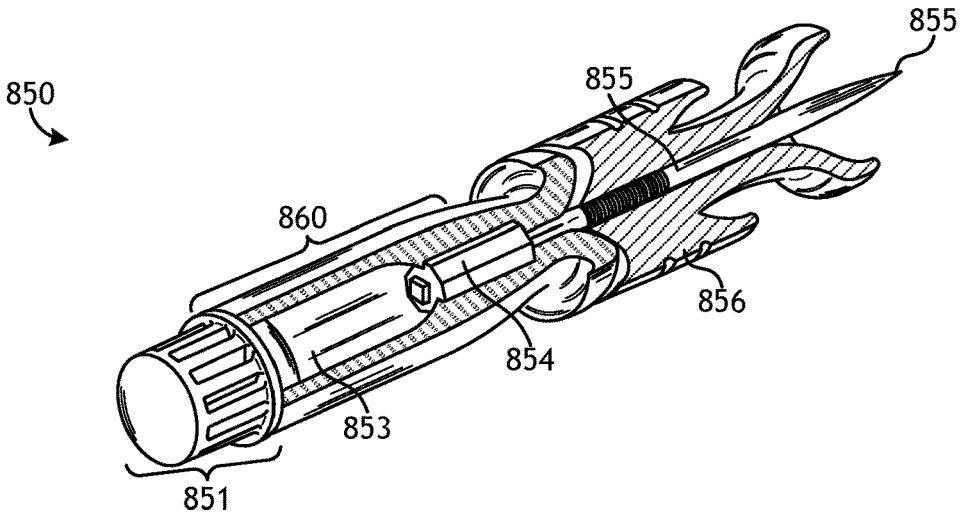
FIG. 8C is an illustration of a projectile within a sabot according to one embodiment of the present disclosure.

FIG. 8C shows another embodiment of a projectile with a sabot. In one embodiment, the internal chamber is part of a sabot. In one embodiment, one or more chambers can be used to spin a thin, elongated projectile, potentially used for penetrating heavily armoured vehicles. For example, in FIG. 8C, munition 850 consists of combustion chamber sabot 860 with an internal chamber 853 and rear part 851 (with outlets). A metal core 854 is located inside chamber sabot 860 such that the penetrator (e.g., the projectile) 855 can be rotated but can also travel independent from the body following exit from the barrel. A saddle sabot 856 surrounds all or a portion of the penetrator 855 to keep the penetrator 855 centered in the barrel. Both the chamber sabot 860 and saddle sabot 856 will separate from penetrator 855 following exit from the barrel. In one embodiment, barrel combustion chamber behind and around the internal combustion chamber provides a majority of the linear acceleration of the projectile. Thin, elongated projectiles (such as that disclosed in FIG. 8C) require very high spin to stabilize, but conventional rifling fails to provide sufficient spin as mechanical engagement has its limits. A thin, elongated projectile has low moment of inertia, compared to its weight, since its mass is distributed close to its rotating axis, and therefore requires a high spin to stabilize. An internal combustion chamber located on a sabot or as part of the projectile can provide the high spins required for a thin, elongated projectile that is not possible based on current technologies.

In one embodiment, each of the different components of the projectile is (e.g., nose, rear, internal chamber, etc.) may be formed of the same or different materials Ammunitions can be built from materials with medium or high modulus of elasticity as long as the design allows for the projectile's deformation without compromising the projectile to barrel frictional relationship. For example, one or more of the components may be made from fiber composite materials, non-elastic materials or materials with a high modulus of elasticity. In one embodiment, the projectile's components may be softer than the material(s) of the barrel. As one example, a low friction mating between the barrel and projectile allows for softer projectile material construction where the maximum combustion pressure of the projectile is not significant and the barrel pressure limit is sufficient. In one embodiment, the projectile may be coated with a low friction coating to reduce the coefficient of friction with the barrel, or rings or sabots can be added to the projectile to reduce the friction. However, a typical carbon fiber to steel coefficient of friction is approximately 0.3, thereby a projectile utilizing this material as the main part of the body interacting with the barrel can be used directly without any type of friction coating. In one embodiment, the tail and backplate of the projectile are a single part and made from conventional materials as they are subject only to difference in pressures between the barrel and the internal chamber, regardless of specific seal type, seal location or absence of seal. In one embodiment, the internal chamber is made of advanced materials that are strong and rigid enough to exhibit dimensional stability in all types of ammunition and calibers such as (but not limited to) composites like carbon, aramid, glass, and fiber reinforced plastics. For example, composite fiber tubes (such as rolled woven carbon fiber fabric) are easily constructed and cost effective. While fiber orientation is important to achieve the necessary pressure limitations, use of such a fiber material can accommodate a higher pressure in the internal chamber than the barrel's pressure limit.

In one embodiment, the projectile is modular. For example, a modular design allows for a number of options to enhance or specialize terminal ballistics performance for the projectile. The advantage of a modular design is the ability to compose the projectile in ways that serve specific purposes by using substantially similar components and/or interchangeable components. For example, FIGS. 6C, 6D, 6E, and 7C provide good examples of modular designs of the disclosed projectile. Different noses, sealing elements, internal chambers, and/or tails may be designed and separately manufactured according to a wide range of shapes and sizes. For a particular application, the desired projectile can be assembled based on coupling separate modular components as appropriate, and can be is inserted into separate shells or casings as necessary. For example, as shown in FIGS. 6C-6E, a common body can be manufactured to couple with different tails and/or nozzles depending on the intended application and projectile requirements.

As mentioned above, the projectile can be utilized with cased or caseless ammunitions. One embodiment utilizes a standard 12 gauge projectile, such as approximately a 70 mm (2.75") total shell length and a 18.60 mm (0.733") diameter. For example, each of the projectiles disclosed in FIGS. 6C, 6D, and 6E are designed for a 12 gauge projectile. These 12 gauge projectiles may share a common carbon fiber body and 4 mm bolt spines; however, by changing noses and/or end caps, a range of operational performance can be covered. This is an example of the modular design of the disclosed projectiles. This approach can allow production of a variety of products based on a matrix of components, thereby minimizing cost.

Figure 9:
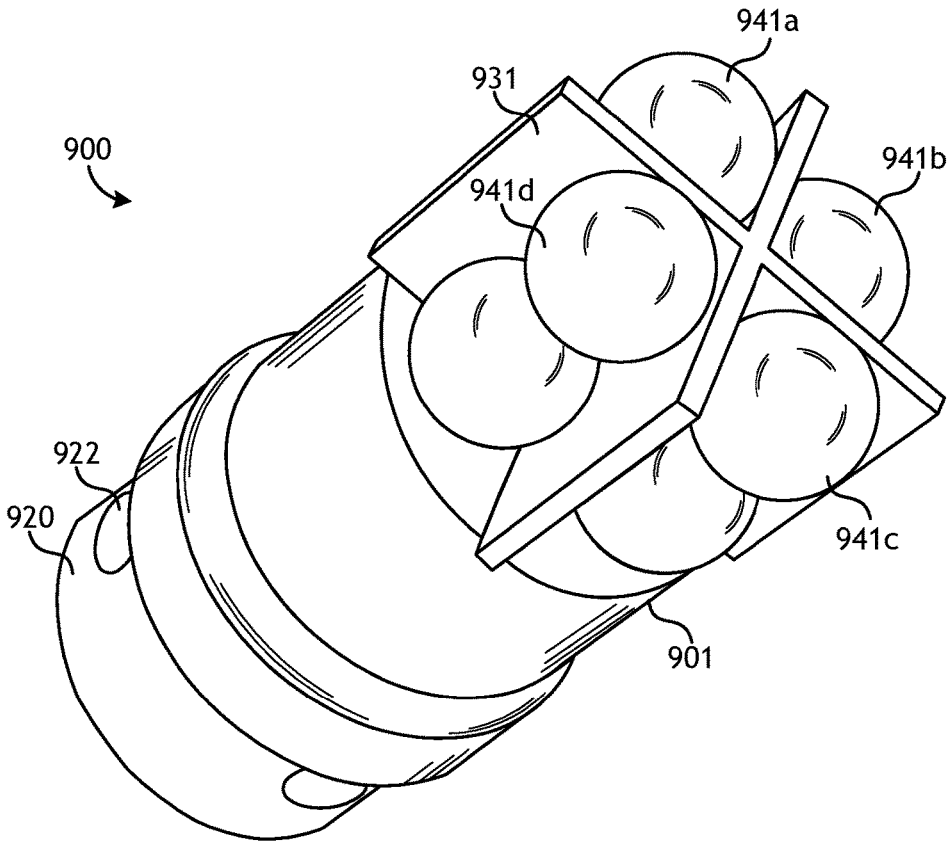
FIG. 9 is an illustration of a projectile with multiple shots/payloads according to one embodiment of the present disclosure.

In one embodiment, increasing the projectile size increases the design flexibility and allows for more sophisticated designs, such as more efficient nozzles, vanes or ducts, higher barrel/projectile pressure limits, easier center of drag placement and greater mass distribution flexibility for center of mass placement. For example, the advantage of having a large bore, in combination with spin, can be exploited by placing a number of projectiles (as compared to just one projectile) as a load to the main projectile spinning body and dispersing them through centrifusion for close range dispersion/scatter rounds, as shown in FIG. 9. FIG. 9 discloses projectile 900 with body 901 coupled to a front portion with a plurality of secondary projectiles 941*a-h*(e.g., shot; only 941*a-d* are labeled for simplicity) and a rear portion or tail 920 that comprises a plurality of outlets 922. The front portion of the projectile may be divided into a plurality of sections or compartments by divider 931. In one embodiment, divider 931 may comprise two perpendicular walls that when coupled together form four sections. Each section may hold a plurality of secondary projectiles, such as two, for a total of eight secondary projectiles. Of course, more or less secondary projectiles are possible. The distance from the muzzle at which the shot (e.g., secondary projectiles) will present an effective pattern can be regulated by adjusting rotational speed via adjustments to amount of propellant, properties of the propellant, ignition timing and location as well as subsequent throttling of the exhaust gases. "Tight" patterns require less angular speed than close range "scatter" shots that need more centrifusion. Scatter rounds for tank guns or shot guns is an area where projectile 900 can is improve the patterns thrown. Selective staged ignition can provide for a range of rotational speeds, making possible to cover a range of dispersion distances with a single ammunition type.

Figure 10:
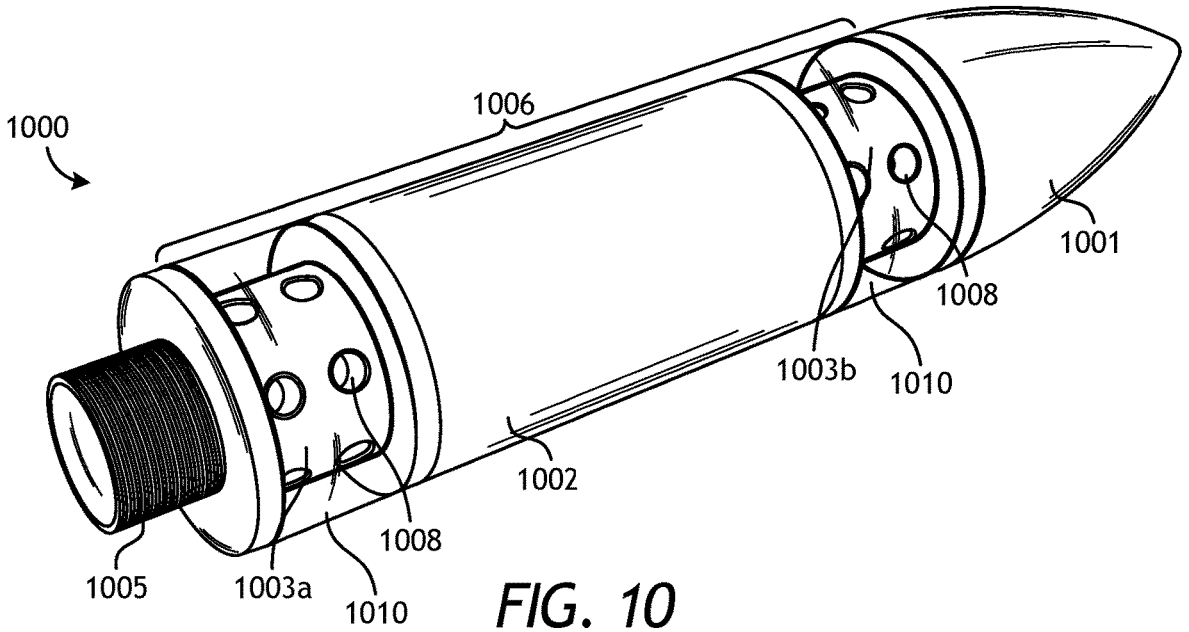
FIG. 10 is an illustration of a projectile according to one embodiment of the present disclosure.

In one embodiment, one or more chambers can be used to expand sealing material on the projectile circumference, such that the projectile can be utilized in weapons of a range of calibers. For example, as illustrated in FIG. 10, projectile 1000 consists of nose 1001, body 1006, three internal chambers 1002, 1003*a*, and 1003*b* located within the body, and tail tube 1005 (which may be threaded in one embodiment). A variety of tails (with corresponding outlets) may be coupled to tail tube 1005. In one embodiment, gas from the combustion in all of the chambers exhausts via tail tube 1005, which can be configured to generate linear and rotational acceleration for the projectile. Further, pressure in chambers 1003*a* and 1003*b* communicates thru outlets 1008 to pressurize and deform sealing material (shown as virtually transparent for illustration) surrounding outlets 1008 and forming an exterior portion of the projectile 1000. In one embodiment, the sealing material surrounding chambers 1003*a* and 1003*b* must have high elasticity, toughness, and low abrasion (such as aluminum), but permanently deforming materials such as plastic, lead or copper alloys can also be used as inflating rings. Having the sealing elements press against the barrel prevents substantial blow by and provides spin stabilization to align the projectile within the barrel (like a floating gyroscope). As described above, chambers 1002 and 1003*a*/1003*b* may have the same ignition source and timing or different sources and timing.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. For example, the barrel used to shoot the projectile may be rifled or non-rifled. The projectile may include a single chamber or multiple chambers, and one or more of the chambers may be separated into multiple compartments. The chambers and/or compartments may have different pressure ratings or the same pressure ratings. The projectile may be ignited directly or indirectly, and may be ignited by a separate chamber placed behind the projectile. The internal chamber may or may not be a combustion chamber. The gas from the internal chamber may be gas generated by combustion or by chemical reaction, and may be any compressed fluid, whether air or liquid. Still further, by placing one more additional chambers (of equal pressure rating) inside the internal chamber of the projectile, the pressure limit of the internal chamber can be significantly increased, such as by up to three times. Obvious modifications and alterations to the described embodiments are available to those with ordinary skill in the art given the teachings disclosed herein. It is emphasized that the foregoing embodiments are only examples of the very many different structural and material configurations that are possible within the scope of the present invention. In conformity with the patent laws, the claims determine the scope or range of equivalents, rather than the disclosed exemplary embodiments, with the understanding that other embodiments within the scope of such claims exist.

What is claimed is:

1. An unguided projectile comprising at least one internal high-pressure chamber configured to exhaust gas from the chamber based on a combustion reaction of propellant inside the chamber while the projectile is located inside a barrel, a plurality of exhaust outlets coupled to the at least one internal chamber, wherein the plurality of exhaust outlets comprises tangential nozzles that are radially spaced on an exterior surface of the projectile and towards a barrel wall to produce an internal chamber pressure that is greater than a barrel pressure based on the combustion reaction within the chamber and to provide rotational force to the projectile, wherein exhaust gas from the plurality of exhaust outlets is restricted against the barrel wall, wherein the internal chamber pressure is independent of the barrel pressure based on the configuration of the plurality of exhaust outlets, wherein substantially all of the propellant is combusted while the projectile is located inside the barrel.

2. The projectile of claim 1, wherein the projectile comprises a plurality of internal chambers.

3. The projectile of claim 2, wherein the plurality of internal chambers comprises a first internal chamber that is configured to provide rotational force to the projectile and a second internal chamber that is configured to provide linear acceleration to the projectile.

4. The projectile of claim 2, wherein the plurality of chambers are selectively ignitable.

5. The projectile of claim 2, further comprising a first mass of a first propellant in at least one of the plurality of chambers and a second mass of a second propellant in at least one of the remaining plurality of chambers.

6. The projectile of claim 1, wherein the at least one internal chamber comprises a first chamber and a second chamber, wherein the second chamber is located within the first chamber, wherein each of the first and second chambers has substantially the same pressure rating.

7. The projectile of claim 1, wherein the at least one internal chamber comprises a passive pressure accumulation chamber.

8. The projectile of claim 1, wherein the at least one internal chamber is configured to control the duration of combustion within the chamber.

9. The projectile of claim 1, wherein the at least one internal chamber is configured for exhaust flow throttling of exhaust gas from the at least one internal chamber.

10. The projectile of claim 1, wherein the exhaust gas is configured to provide linear and angular acceleration to the projectile.

11. The projectile of claim 1, further comprising a turbine coupled to the at least one chamber, wherein the turbine converts pressure from the at least one chamber to angular acceleration for the projectile, wherein the turbine is axial or centrifugal or a hybrid of axial or centrifugal.

12. The projectile of claim 1, wherein the projectile is configured to produce sufficient torque to induce stabilization level projectile spin without the need of barrel rifling.

13. The projectile of claim 1, wherein the projectile is configured for use in non-rifled barrels.

14. The projectile of claim 1, wherein the projectile is configured to produce an approximately trapezoidal pressure trace in a barrel used to shoot the projectile.

15. The projectile of claim 1, wherein the projectile is configured for use in shelled/cased ammunition or caseless ammunition.

16. The projectile of claim 1, further comprising an inbuilt sacrificial safety device that breaks at a predetermined pressure.

17. The projectile of claim 1, further comprising a seal located on an exterior portion of the projectile.

18. The projectile of claim 17, wherein the seal comprises an inflatable sealing ring configured to expand by internal pressure of the at least one internal chamber.

19. The projectile of claim 1, wherein the at least one chamber comprises a cylindrical tube made of fiber reinforced composite.

20. An unguided projectile comprising at least one internal chamber;

propellant disposed in the at least one internal chamber;

a plurality of exhaust outlets coupled to the at least one internal chamber;

a tail; and a nose, wherein the plurality of exhaust outlets is configured to exhaust gas from the at least one internal chamber based on a combustion reaction of propellant inside the chamber while the projectile is located inside a barrel, wherein the plurality of exhaust outlets comprises tangential nozzles that are radially spaced on an exterior surface of the projectile and towards a barrel wall to produce an internal chamber pressure that is greater than a barrel pressure based on the combustion reaction within the chamber and to provide rotational force to the projectile, wherein exhaust gas from the plurality of exhaust outlets is restricted against the barrel wall, wherein the internal chamber pressure is independent of the barrel pressure based on the configuration of the plurality of exhaust outlets, wherein substantially all of the propellant is combusted while the projectile is located inside the barrel.

21. The projectile of claim 20, further comprising a sabot, wherein the at least one internal chamber is located within the sabot.

22. A munition, comprising a cartridge case;

a projectile coupled to the cartridge case, wherein the projectile comprises at least a tail and a nose;

a first chamber located within the cartridge case and behind the projectile; and a second chamber located within the projectile, wherein the second chamber is coupled to a plurality of exhaust outlets, wherein the plurality of exhaust outlets is configured to exhaust gas based on a combustion reaction of propellant inside the second chamber while the projectile is located inside a barrel, wherein the plurality of exhaust outlets comprises tangential nozzles that are radially spaced on an exterior surface of the projectile and towards a barrel wall to produce a second chamber pressure that is greater than a barrel pressure based on the combustion reaction within the second chamber and to provide rotational force to the projectile, wherein exhaust gas from the plurality of exhaust outlets is restricted against the barrel wall, wherein the second chamber pressure is independent of the barrel pressure based on the configuration of the plurality of exhaust outlets, wherein substantially all of the propellant is combusted while the projectile is located inside the barrel.

23. The munition of claim 22, wherein the first chamber is configured to directly ignite the second chamber.

24. The munition of claim 22, wherein the first chamber is configured to indirectly ignite the second chamber.

25. The munition of claim 22, further comprising a first mass of a first propellant located in the first chamber and a second mass of a second propellant located in the second chamber, wherein the first propellant is coupled to a first ignition source and the second propellant is coupled to a second ignition source.

26. The munition of claim 22, wherein the first and second chambers are configured to ignite at separate times.

* * * * *